US006830858B2

(12) United States Patent
Sugino et al.

(10) Patent No.: US 6,830,858 B2
(45) Date of Patent: Dec. 14, 2004

(54) ELECTROPHOTOGRAPHIC PHOTOSENSITIVE MEMBER, PREPARATION METHOD THEREOF, IMAGE FORMING PROCESS, APPARATUS AND PROCESS CARTRIDGE USING THE SAME

(75) Inventors: Akihiro Sugino, Numadu (JP); Yasuo Suzuki, Fuji (JP)

(73) Assignee: RICOH Company, Ltd., Tokyo (JP)

( * ) Notice: Subject to any disclaimer, the term of this patent is extended or adjusted under 35 U.S.C. 154(b) by 152 days.

(21) Appl. No.: 10/180,316

(22) Filed: Jun. 27, 2002

(65) Prior Publication Data

US 2003/0129512 A1 Jul. 10, 2003

(30) Foreign Application Priority Data

Sep. 4, 2001 (JP) ..... P2001-267609
Jun. 24, 2002 (JP) ..... P2002-182660

(51) Int. Cl.[7] ..... G03G 5/05; G03G 5/147

(52) U.S. Cl. ..... 430/66; 430/59.6; 430/96; 430/126; 430/132; 399/159

(58) Field of Search ..... 430/66, 59.6, 96, 430/126, 132; 399/159

(56) References Cited

U.S. PATENT DOCUMENTS 5,028,502 A 7/1991 Yuh et al.
5,100,453 A 3/1992 Richards
5,286,588 A 2/1994 Suzuki
5,561,016 A 10/1996 Suzuki et al.
5,578,405 A 11/1996 Ikegami et al.
5,665,500 A 9/1997 Suzuki
5,677,096 A 10/1997 Suzuki
5,789,128 A 8/1998 Adachi et al.
5,834,145 A 11/1998 Yshinaga et al.
5,846,680 A 12/1998 Adachi et al.
5,910,386 A * 6/1999 Yoshinaga et al. ..... 430/66
5,910,561 A 6/1999 Adachi et al.
5,928,828 A 7/1999 Suzuki
5,942,363 A 8/1999 Tanaka et al.
5,999,773 A 12/1999 Yasutomi et al.
6,026,262 A 2/2000 Kinoshita et al.
6,030,736 A 2/2000 Ikegami et al.
6,069,224 A 5/2000 Adachi et al.
6,136,483 A 10/2000 Suzuki et al.
6,191,249 B1 2/2001 Tanaka et al.
6,249,304 B1 6/2001 Sawayama et al.
6,322,940 B1 11/2001 Nishigaki et al.
6,326,112 B1 12/2001 Tamura et al.
6,366,751 B1 4/2002 Shakuto et al.
6,432,596 B2 8/2002 Ikuno et al.
6,444,387 B2 9/2002 Ri et al.
6,492,079 B2 12/2002 Shimada et al.
6,492,081 B2 * 12/2002 Morikawa et al. ..... 430/66
6,573,016 B2 * 6/2003 Kami et al. ..... 430/58.05

* cited by examiner

*Primary Examiner*—John L Goodrow
(74) *Attorney, Agent, or Firm*—Oblon, Spivak, McClelland, Maier & Neustadt, P.C.

(57) ABSTRACT

An electrophotographic photosensitive member having a photosensitive layer provided on an electro-conductive supporting substrate and a protection layer provided on the photosensitive layer. The protection layer includes a kind of finely divided metal oxide particle, an organic acid, and a binder resin. The binder resin is a thermo-curable resin. The organic acid is contained in an amount of 0.05 wt. % to 5 wt. % for the amount of the thermo-curable resin. The photosensitive member has a high durability capable of stable image productions for a long period of utilizable time, due to the protection layer.

25 Claims, 9 Drawing Sheets

ELECTROPHOTOGRAPHIC PHOTOSENSITIVE MEMBER, PREPARATION METHOD THEREOF, IMAGE FORMING PROCESS, APPARATUS AND PROCESS CARTRIDGE USING THE SAME

FIELD OF THE INVENTION

The present invention relates to an electrophotographic photosensitive member used for a image forming apparatus such as copy machine, electrostatic printing, facsimile, laser printer and electrostatic recording, a preparation method thereof, an image forming process, an apparatus and a process cartridge using the electrophotographic photosensitive member. More specifically the present invention relates to an electrophotographic photosensitive member used for an image forming apparatus, a preparation method thereof, an image forming apparatus which is capable of forming high quality of images with high speed operation for a long period of repeated use time.

DESCRIPTION OF THE RELATED ART

There are corona charging method and contact charging method used in electrophotograpy, those both have been used as electric charging method to make the photosensitive member electrically charged. The corona charging method contains corotron charging method and scotron charging method having a grid, those are a method in which AC potential or DC-overlapped AC potential is applied to the charging wire such as tungsten wire or nickel wire and so forth which being stretched on the central position of a housing shielded by metal plate, thereby corona discharge is induced which makes electrically charged photosensitive member.

However in this kind of method a high voltage is applied to the charging wire thus occurs ozone and nitrogen oxides products. And it has been known that such oxidant products affect bad influences upon, not only environmental aspect, but also the photosensitive member from the viewpoint of their durability and characteristics of produced image.

In recent years, instead of above described method using the charging wire for corona discharging, the contact charging method has been used in practice for the purpose of obtaining a lowered or an eliminated generation of ozone and a lowered consumption of electric power. The contact charging method is a method in which AC potential or DC-overlapped AC potential is applied to a charging member having electric resistance from $10^2$ to $10^{10}$ Ω·cm degree, which is pressed to contact with the surface of an electrophotographic photosensitive member, thereby the electrophotographic photosensitive member is electrically charged. This charging method, which is subjected Paschen's law, is effectuated by a discharge emitted from the charging member toward the photosensitive member as charge-receiving member, therefore the charging of the photosensitive member is initiated by applying electric potential more than threshold level of voltage. In the execution of the contact charging method, an electric potential level to be applied may be lowered in comparison with that of corona charging method, but the method accompanies with an inevitable discharging, thus generates small amount of ozone and nitrogen oxides.

And the contact charging method causes a contact of charging member with the surface of the electrophotographic photosensitive member (hereinafter may also be referred as photoreceptor), therefore there is a problem that the abrasion of the surface of the electrophotographic photosensitive member is increased.

In the field of electrophotographic apparatus the demands such as higher quality image reproduction, higher tolerance, lower running cost and full-color imaging have been growing large in market in recent years. Particularly a full-color duplication has been popularized by the commercial diffusion of color printer and color copier, thus a demand for duplicating full-color image with almost same high speed as that of mono-color printing has growing. For satisfying this demand an attention has been paid to so called tandem type of full-color image forming apparatus. The tandem type of full-color image forming apparatus includes a plurality of photosensitive members arranged in parallel and equipped with developing unit respectively, and respective single colors formed on each photosensitive member are transferred and overlaid one by one onto the surface of recording member to make composed color image. This tandem type of full-color image forming apparatus is capable of significant time saving for printing action, in comparison with that of so called one drum type of image forming apparatus which employs only one photosensitive member and thereon are repeated a plurality of image forming actions (usually four times of action) to form full-color image. However such tandem type of full-color image forming apparatus has a plurality of image forming sections independent each other, therefore becomes large in apparatus scale, thus is apt to be expensive.

At the present time, with a demand for obtaining high quality of color image by color printer or color copier, as light sources for such photo-printers, the application of laser diodes (LDs) and light emitting diodes (LEDs) both which have smaller light beam diameter capable of high power emission so as to make itself capable of a finer dot recording has been prevailingly be trended in the field of image forming apparatus. Meantime, thicker CTL (charge transfer layer) of photosensitive member causes more decreased straight passages in the CTL for electric charges which are injected into the CTL and arrive to the surface of the CTL to neutralize the surface charges having opposite polarity, hence occurs blurring of images formed, therefore it is required to shorten the thickness of CTL.

Generally speaking, in Carlson process, the CTL is abraded and decreases its thickness by its repeated uses. Accordingly, for the purposes of avoiding the generation of smearing in back ground area of printed image or avoiding the decrease of the image density which are caused by decrease in electric charge potential and decrease in photosensitivity of the photosensitive member, it is thought to shorten the thickness of the CTL, but such shortening of the CTL thickness was disadvantageous from the point of view to attain high durability of the photosensitive member.

There is a tendency to require a higher sensitivity and a higher responsibility of the photosensitive member in accompanying with an achievement of high speed electrophotographic apparatus, a smaller photosensitive member in accompanying with an achievement of down sized apparatus, thus requiring a higher tolerance of the photosensitive member. For such requirements Japanese patent No 2838891 considered the quantum efficiency in dependence on the strength of electric field in photosensitive member, and discloses a photosensitive member which is achieved a high sensitivity, compatible with an improved durability, by the combination of a CTL having relatively large value of 25 to 60 μm in thickness and a CGL (charge generating layer) having quantum efficiency depended slightly upon the strength of electric field. However there was a shown drawback with this photosensitive member that it reveals the decease in sensitivity pursuant to the decrease in thickness of CTL caused by abrasions of the layer in the photosensitive member used repeatedly.

Hereupon, an electrophotographic photosensitive member has been designed and used in real which has an improved anti-abrasion nature by providing a protection layer on the photosensitive layer.

For instances Japanese Patent Laid-open Publication of Tokkai Shou 63-91666 discloses a technique to provide a protection layer made of silicone material on the photosensitive layer, Japanese Patent Laid-open Publication of Tokkai Hei 03-155558 discloses a technique to provide a protection layer made of curable silicone resin, Japanese Patent Laid-open Publication of Tokkai Shou 60-3639 discloses a technique to make a protection layer made of a composed mixture of a curable resin and an acrylic resin, Japanese Patent Laid-open Publication of Tokkai Shou 57-176057 discloses a technique to provide an insulate protection layer made of a fluoride resin dispersing therein powder of hard particles onto the photosensitive layer, Japanese Patent Laid-open Publication of Tokkai Shou 63-18354 discloses a technique to provide a protection layer containing anti-oxidant, and Japanese Patent Laid-open Publication of Tokkai Hei 01-205171 discloses a technique to improve the tolerance of the most upper layer by incorporating therein an inorganic filler of particles.

However, it is known that in such kind of photosensitive members, which have an improved anti-abrasion nature, occur an adhesion of products produced in discharging course to the surface of photosensitive member, and it becomes small in the electric resistance of the surface of photosensitive member. But the removal by abrasion of the outermost surface thin layer materials having been decreased in electric resistance is not conducted because of its strong anti-abrasion nature, and eventually electrostatic charge is not held on the surface, hence occurs phenomena such as image drifting and image blurring.

Therefore, in conventional electrophotographic photosensitive member which has been given an improved anti-abrasion nature by the protection layer containing filler, the prevention of image blur has been executed by slightly abrading the surface of protection layer by controlling filler amount to be contained in the protection layer. In such constitution of the photosensitive member, to make abrading of the protection layer even very scarce degree of abrasion, the protection layer must be formed with a certain thickness, but thickened protection layer is apt to conduct side effects such as an elevated electric potential at lightening exposed area and so forth.

With regard to copy machines commercially available, there is a copy machine which carries on a photosensitive member having prolonged life time capable of 1000 kilo running. Actually in this copy machine a drum heater is inserted in the inside space in hollow configuration of photosensitive member, for preventing a generation of image blur, therefore is unavoidable from the use of complexion and enlarged diameter of thus considerably expensive photosensitive member. Further it is a energy consumable due to the heater. By these reasons, the photosensitive member having a protection layer on its surface and heater in its inside is difficult to use for the tandem type of image forming apparatus, therefore implementation thereof is not yet realized until now.

It is desirable to give a comparatively thin layer thickness in the protection layer, because side effects such as elevation of electric potential at lightening exposed area and so forth are suffered from the accumulation of electric charges. As a mater of course, anti-abrasion nature that is hard to abrade for a long period of repeated operation time is required. On the other hand, photosensitive member having such improved anti-abrasion nature occurs adhesion of products produced during discharging course thus results decreasing of electric resistance at surface of the photosensitive member, the abrasive removal of the outermost surface thin layer material having thus been decreased in electric resistance is however not conducted because of its strong anti-abrasion nature, and eventually electrostatic charge is not held on the surface, hence occurs phenomena such as image drifting and image blurring. By these reason, it has been difficult to implement photosensitive member which having protection layer hardly abraded and having hardly occurring image blurring even if without use of auxiliary apparatus such as drum heater and the like.

SUMMARY OF THE INVENTION

It is therefore an object of the present invention to provide an electrophotographic photosensitive member having high durability capable of stable image productions for a long period of utilizable time.

It is another object of the present invention to provide a coating liquid for forming a protection layer for the electrophotographic photosensitive member, and a production method of the electrophotographic photosensitive member.

It is still another object of the present invention to provide an image forming process using the electrophotographic photosensitive member.

It is still another object of the present invention to provide an image forming apparatus using the electrophotographic photosensitive member.

It is still another object of the present invention to provide a process cartridge using the electrophotographic photosensitive member.

Having been focussed to the above described objects with regard to protection layer which has to be a strong anti-abrasion nature and show no blurring in images for long period of operation time, serial concentrated studies have been strenuously conducted for the purpose of solving above described problems which were belonged to conventional techniques.

And as a result, it is found out that significant improvements that an excellent anti-abrasion nature is shown, excellent images are reproduced for long period of running time with no or hardly generated image blurring are achieved by employing; an electrophotographic photosensitive member having a photosensitive layer provided on an electroconductive supporting body and a protection layer provided on the photosensitive layer, wherein the protection layer comprising at least finely divided particles of metal oxide, an organic acid and a binder resin, the binder resin is a thermo-curable resin, the organic acid being contained an amount of 0.05 wt. % to 5 wt. % for the amount of the thermo-curable resin-wherein the protection layer comprising at least finely divided particles of metal oxide, an organic acid, and a binder resin, the binder resin is a thermo-curable resin, the organic acid contained is contained an amount of 0.05 wt. % to 5 wt. % for the amount of the thermo-curable resin.

It has been known that for example in case of poly carbonate resin, which has a comparatively high hardness among various thermoplastic resins, is used as binder resin for the protection layer, if high strength is given to the poly carbonate resin so as to make it causing no or only scarce abrasion, image blur takes place. It is though that this phenomenon is caused by a mechanism that there are existing a number of poly carbonate bonding sites in the poly carbonate resin, therefore products in discharging are absorbed to the bonding sites, and absorbents are gradually accumulated thereby surface electric resistance is dropped hence charges arc not held.

In contrast to this, with a photosensitive member having a protection layer by the present invention, no or very low blur is generated in spite of very low abrasion with the photosensitive member surface. The reason for the phenomenon is not clear yet, but following issues may be thought at the present moment.

In case of that the surface of photosensitive member is abraded by contacts with contacting members such as recording member instanced as paper sheet and so forth, cleaning member instanced as counter blade, the electrophotographic photosensitive member used in the present invention includes finely divided particles of metal oxide, therefore above described contacting members contact with not only resin materials used in the protection layer but also the metal oxide particles contained in the protection layer. Here, the metal oxide particles have enough hardness, and hardly abraded, in comparison with above described contacting members which basically consisting of aggregated moleculars and are govern by mainly Van der Waars bondings acting as inter-moleculars bonds, therefore can prevent or suppress the abrasion of resin part of protection layer, hence improving anti-abrasion nature.

And, the binder resin of the protection layer in the present invention is made by heat curing of curable resin, therefore cross-linking reaction between resin moleculars makes combined each resin material.

In general, cross-linking reactions in curable resins are irreversible reactions, thus number of radical groups is decreased with the progress of bonding reaction between the radical groups. As already described above, the products produced in discharging are absorbed to the bonding sites. In case of absorbing the products produced in discharging onto the surface of electrophotographic photosensitive member, it is thougth that more existence of radical group leads to easier absorption of the products in discharging onto the surface of the photosensitive member, and absorbed products become difficult to remove the surface.

It is thought on the contrary that, the electrophotographic photosensitive member of the present has smaller number of radical groups at the surface, therefore is afraid to absorb the products in discharging to the surface of the photosensitive member, as a result, deposition of the products in discharging to the surface of the photosensitive member is suppressed, and if any deposition is brought with the products, the deposited products are endowed with weak adhesion strength thus can be removed easy, accordingly the decrease of an electric resistance is difficult in case of the electrophotographic photosensitive member of the present.

And, in the present invention an organic acid is contained in the protective layer. This acid works as a catalyst at cross-linking reaction of resin, and by this acid, cross-linking reaction of resin is fully progressed at relatively low temperature in relatively short time, thus existence of residual reactive radical groups can suppress in fewer level, than that of the reaction system containing no organic acid. The existence of residual reactive radical groups are possible sites for absorbing the products produced in discharging, thereby decreasing of the electric resistance is likely to cause an image blur. And the existence of residual reactive radical groups, with the time lapse, may be changed to charge traps in a forbidden energy level of the electrophotographic photosensitive member, acting as elements inducing an electric potential rising of light-exposed area in the electrophotographic photosensitive member.

The use of organic acid as a hardening agent for curable resin, as such technique itself has been known in the art of electrophotographic photosensitive member. For instances Japanese Patent Laid-open Publication of Tokkai Hei 06-266142 discloses a technique to use organic acid such as prenic acid anhydride, pyromellitic acid anhydride, trimellitic acid anhydride as a hardening agent to make cure the epoxy resin used for protection layer of electrophotographic photosensitive member, Japanese Examined Patent Publication of Tokkou Hei 06-90539 discloses a technique to use inorganic acid, organic acid or amine as a hardening agent for protection layer consisting of a mixture resin of curable silicone resin and acrylic resin containing therein finely divided particles of tin oxide, titanium dioxide, indium oxide, antimony oxide and the like having diameter of 10 nm to 20 nm.

However, the amounts of inorganic acid, organic acid or amine as a hardening agent added in protection layer are no more than catalystic amount in conventional techniques. It was an anxiety of the skilled in the art that the use of excess amount of the catalyst also may result the existence of residual hardening catalyst which was also apt to be active sites capable of absorbing the products produced in discharging, acting as elements inducing an electric potential rising of light-exposed area in the electrophotographic photosensitive member, thereby decreasing of the electric resistance was likely to cause an image blur. Accordingly the avoidance for such addition of excess acid into the protection layer might be a normal sense.

Rising of electric potential in exposed area by light emission causes an irregular image, therefore it has been thought that hardening condition likely to remain the reactive radical groups after completion of the hardening reaction is unfavorable. For the purpose of accelerating the hardening reaction with suppressing the residual reactive radical group under the condition of no existence organic acid, longer reaction time and higher reaction temperature are required, however if larger amount thermo-energy is imposed, there may be brought drawbacks that the photosensitive member does not show a necessary sensitivity for emitted light and so forth, due to changes of charge transfer material and charge generation material. And if not any change, there is required much more energy to make harden the used resin, hence environmental load becomes larger thus unfavorable.

By the way, if a protective layer including fine particles of metal oxide is overlaid on a CTL, there is a possibility of accumulation of the remained charges in course of repeated uses of the photosensitive member, and thereby the rising of electric potential at exposed area by light emission is induced. It is thought that the inter surfaces between metal oxide fine particles, between metal oxide fine particle and resin material, between them and charge transfer material acts as traps for the charges, which impede the smooth immigration of the charges.

In this case, it is thought to suppress such charges accumulation of the residual charges, by increasing the amount of charge transfer material included, however it is worried that larger ratio of the contained charge transfer material causes more decreased anti-abrasion nature. And in generally speaking, the charge transfer material may be expensive, hence conducts a cost escalation of the produced photosensitive member.

As compared with above described technique, an amount of the contained organic acid for the amount of used resin in the present invention is in the range of 0.05 wt. % to 5 wt. %. And it is thought that the organic acid in the present invention is used as not only catalyst, but also it acts as Lewis acid in the protection layer to cooperate with the charge transfer material which in almost all case shows a basic characteristic nature, pursuant to its aromatic poly-ring structure, and it acts as an agent for mitigating the relaxation state in the binder polymer material composing protection layer, to decrease the permeability of ozone, nitrogen oxide, water vapor and so forth. Accordingly in taking consideration of a balancing between the catalystic effect and the effects of Lewis acid and the polymer conformation-shrinkage effect, favorable amount of the organic acid is in the range of 0.1 wt. % to 3 wt. %.

Namely, the organic acid acts as a catalyst in the course of curing of the binder resin, and thereafter is remained in the protection layer to decrease the bulk resistance of the protection layer, and to release the latent heat which impedes the electric conductivity. In this situation, it is thought that the organic acid in the present invention is excellent in compatibility with the resin, therefore does not localizes, thus exhibits an effect to reduce the electric resistance properly over the whole span. In this case if inorganic acid is used as an acid, it is apprehensive that the inorganic acid is inferior in compatibility with the resin thus localizes in the protective layer at an occasion of it being left in the protection layer. If the acid localizes in the protection layer, in that local sites, an extreme reduction of the electric resistance are induced, thereby initial and dark (not exposed by light) electric potential are reduced in that spots, thus they cause irregular image such as black spots and the like. On the other hand, in the preparation of a coating liquid for forming the protection layer, organic solvents are used in almost cases in due consideration of solubility of resin and charge transfer material, on such occasions use of inorganic acid is poor solubility for the organic solvents, therefore is unfavorable from the viewpoint of the stability of coating liquid.

Further, by the present invention, an electrophotographic photosinsitive member characterized by using aromatic sulfonic acid or derivatives thereof. It becomes now clear in the present invention that the aromatic sulfonic acid or derivatives thereof show a strong acidity and a high effect as of catalyst, therefore hardening reaction of the resin may get off by a small energy, thus causing large effects in the energy saving and lowering the environmental load, and the sulfonic acid has an excellent solubility in the organic solvents, therefore is satisfactory in the stability of the coating liquid, the workability in course of forming the protection layer, and so forth. Further, it shows a good compatibility with resin, accordingly is difficult to generate above described black spots.

And, the electrophotographic photosensitive member used in the present invention can suppress an image drifting without heating by drum heater and the like, therefore the installation of the drum heater at the inside space of or closed to the electrophotographic photosensitive member loaded on image forming apparatus, thus is effective for down sizing of the image forming apparatus and for the energy saving purpose. Further the lay out of wiring and mechanism regarding with the heater can be eliminated, that is effective for the simplification of image forming apparatus, hence a reduction of the cost and a save of energy can realized.

As described hereto, according to the present invention, there is a provided an electrophotographic photosensitive member having a photosensitive layer provided on an electroconductive supporting substrate and a protection layer provided on the photosensitive layer, wherein the protection layer comprising at least finely divided particles of metal oxide, an organic acid, and a binder resin, the binder resin is a thermo-curable resin, the organic acid contained is contained an amount of 0.05 wt. % to 5 wt. % for the amount of the thermo-urable resin. Here, in case of an included amount of organic acid less than 0.05 wt. % for the amount of resin, even if the action as a catalyst may achieve, there is a possibility that the effect for suppressing above described elevation of residual electric potential becomes smaller, therefore the effect to suppress increases of electric potential at light exposed area by repeated uses. And in case of an included amount of organic acid more than 5 wt. % for the amount of resin, there is a possibility that the bulk electric resistance becomes too much smaller, thus electrostasic charge being charged on the surface of the photosensitive member is not held, hence may occur image drifting and smear at back ground area, thus is unfavorable. In particularly under the condition of high temperature and high humidity such tendency becomes significant.

And, according to the present invention, An electrophotographic photosensitive member of above described type having a photosensitive layer provided on an electroconductive supporting substrate and a protection layer provided on the photosensitive layer, wherein the protection layer comprising a charge transfer material is provided. By such inclusion of a charge transfer material into the protection layer, the electrophotographic photosensitive member showing a reduced residual electric potential and a reduced delay of rising up time in electric charging is implemented.

The ratio by weight of binder resin and the charge transfer material in the protection layer is favorable to be in the range of 3/1 to 1/3. In case of the ratio less than 3/1, there is a possibility that the charges can not migrate smoothly in the protection layer, therefore the effect to suppress the residual electric potential becomes insufficient. On the other hand, in case of the ratio more than 1/2, there is the possibilities that the hardening of resin in the protection layer is impeded, and the charge transfer material is crystallized out to the protection layer, those cause a reduction of anti-abrasion nature of the protection layer or an inferiority of image reproduced. In case of the ratio in the range of 3/1 to 1/3, the charges can migrate smoothly in the protection layer, the effect to suppress the residual electric potential becomes sufficient enough. And, a reduction of anti-abrasion nature of the protection layer and an inferiority of image can prevented, with no impedance of hardening of resin in the protection layer and nor crystallizing out of the charge transfer material.

By the present invention, the curable resin of the protection layer constitutes from a thermo-curable acrylic resin, a melamine resin, a benzo-quanamine resin, thereby an electrophotographic photosensitive member, which has a sufficient anti-abrasion nature, an excellent electrostatic property, and a lowered production cost, can be realized.

Namely, a favorable mode of the present invention concerns with an electrophotographic photosensitive member having a protection layer formed by heating to cure above described thermo-curable acrylic resin, and a melamine resin and/or a benzo-quanamine resin.

The electrophotographic photosensitive member having a protection layer formed by heating to cure a thermo-curable acrylic resin, and a melamine resin and/or a benzo-quanamine resin so as to make a three dimensional network structure by cross-linking reaction, and the protection layer is excellent in film-forming characteristic thus can form a smooth surface, has a sufficient anti-abrasion nature and a excellent electrostatic, property, and can be produced by a reduced cost. And the compatibility of the thermo-curable acrylic resin, with the melamine resin and/or the benzo-quanamine resin is very good, therefore a protection layer showing high transparency can be formed.

Among those materials, at least one material is favorable to be the thermo-curable acrylic resin.

And at least one material other than the thermo-curable acrylic resin in those materials is favorable to be the melamine resin or the benzo-quanamine resin.

Further, the present invention includes a favorable mode in which the ratio by weight of the thermo-curable acrylic resin, and the melamine resin or/and the benzo-quanamine resin is in the range of 9/1 to 4/6.

Pursuant to experiments, excellent results were shown in the durability for abrasion and the dispersion stability of the metal oxide,and the hardness of the hardened resin and so forth, in case of the ratio by weight of the thermo-curable acrylic resin, and the melamine resin or/and the benzo-quanamine resin was in the range of 9/1 to 4/6.

Further, the electrophotographic photosensitive member of the present invention, as described above, is a photosensitive member which is decreased in the permeability of hazard gas such as ozone, nitrogen oxides, water steam and so forth. The protection layer thereof is favorable to have a permeability less than or equal to 50 mg—2 days–1–1.

Furthermore, as already described above, the electrophoyographic photosensitive member used in the present invention can suppress the image drifting without heating by drum heater and the like, therefore the installation of the drum heater at the inside space of or closed to the electrophotographic photosensitive member loaded on image forming apparatus, thus is effective for down sizing of the image forming apparatus and for the energy saving purpose. Further the lay out of wiring and mechanism regarding with the heater can be eliminated, that is effective for the simplification of image forming apparatus, hence a reduction of the cost and a save of energy can realized.

Such kind of the electrophotographic photosensitive member of the present invention is, not essential, but favorable to be a laminated type of photosensitive member which has an ognanic photosensitive layer consisting of a CGL and a CTL over laid one by one. A function-sharing type of photosensitive layer in which charge generation function is separated from charge transfer function is prepared by constituting the photosensitive layer with a CGL and a CTL over laid one by one, And in such kind of the electrophotographic photosensitive member of the present invention can be an electrophotographic photosensitive member having an under coated layer between an electrophotoconductive supporting substrate and the photosensitive layer. By providing the under coated layer, improvements such as an improvement of adhesive property, prevention of moire, an improvement of coating operation, reduction of residual electric potential can be designed.

Further, by the present invention, there is provided a coating liquid used for forming the protection layer of the electrophotographic photosensitive member, which consists of a binder resin including a curable resin, a fine powder consisting of metal oxides particles, an acid catalyst, a charge transfer material which being added if necessary, wherein the solid content is in a range from 0.5 to 30 weight % for the total coating liquid.

Further, by the present invention, there is provided a preparation method of an electrophotographic photosensitive member comprising steps of applying a coating liquid used for forming the protection layer of the electrophotographic photosensitive member by spraying the coating liquid onto a photosensitive layer, then heat-setting it to form the protection layer, wherein the coating liquid is a coating liquid used for forming the protection layer of the electrophotographic photosensitive member, which consists of a binder resin including a curable resin, a fine powder consisting of metal oxides particles, an acid catalyst, a charge transfer material which being added if necessary, and the solid content is in a range from 0.5 to 30 weight % for the total coating liquid.

Further, by the present invention, there is provided an image forming process comprising at least steps being repeatedly conducted of latent image forming step for forming an electric latent image upon the aforementioned electrophotographic photosensitive member, developing step for developing the latent image to make a toner image, toner image transfer step for transfer the toner image onto a image receiving medium.

The image forming process shown an excellent anti-abrasion nature of the surface of the photosensitive member, thus excellent images are reproduced for long period of running time with no or hardly generated image blurring.

Further, by the present invention, there is provided an image forming process according to the aforementioned image forming process, wherein the latent image forming step for forming an electric latent image upon the aforementioned electrophotographic photosensitive member is a latent image forming step comprises steps of a charging step for electrically charging the aforementioned electrophotographic photosensitive member, and an exposing step for exposing the electrophotographic photosensitive member in image wisely by exposing with a light irradiation of image shape or with an emission of the light beam.

It is possible to directly give the electric latent image onto the electrophotographic photosensitive member by using a special electrode, however for demonstrating the excellent property of the electrophotographic photosensitive member, the latent image forming procedure using the exposure with a light irradiation of image shape or with an emission of the light beam are advantageous.

Further, by the present invention, there is provided an image forming apparatus equipped with an electrophotographic photosensitive member having a photosensitive layer provided on an electrically conductive supporting substrate and a protection layer provided on the photosensitive layer, a latent image forming apparatus for forming an electrostatic latent image on the surface of the electrophotographic photosensitive member, a developing apparatus for developing the electrostatic latent image, wherein the protection layer comprising at least finely divided particles of metal oxide, an organic acid and a binder resin, the binder resin is a thermo-setting resin, the organic acid being contained an amount of 0.05 wt. % to 5 wt. % for the amount of the thermo-setting resin.

The image forming apparatus shown an excellent anti-abrasion nature of the surface of the photosensitive member, thus excellent images are reproduced for long period of running time.

Further, by the present invention, there is provided an image forming apparatus having a plurality of image forming units, and each image forming unit equipped with respectively an electrophotographic photosensitive member having a photosensitive layer provided on an electric conductive supporting substrate and a protection layer provided on the photosensitive layer, a latent image forming apparatus for forming an electrostatic latent image on the surface of the electrophotographic photosensitive member, a developing apparatus for developing the electrostatic latent image to make a toner image, a toner image-transfer unit for transfer the toner image, and the image forming apparatus having a toner image-receiving mean which is suffered from the transfers of each toner images on the surface thereof, a driving mean for driving the toner image-receiving mean so as to move the surface of the toner image-receiving mean to sequentially face the surface thercof to the each surface of respective electrophotographic photosensitive member, wherein the protection layer comprising at least finely divided particles of metal oxide, an organic acid and a binder resin, the binder resin is a thermo-setting resin, the organic acid being contained an amount of 0.05 wt. % to 5 wt. % for the amount of the thermo-setting resin.

The image forming apparatus shown an excellent anti-abrasion nature of the surface of the photosensitive member, thus excellent images are reproduced for long period of running time with no or hardly generated image blurring, if spite of equipped with no drum heater.

Further, by the present invention, there is provided an image forming apparatus according to aforementioned image forming apparatus, wherein the latent image forming apparatus is a latent image forming apparatus having an electric charging member contacted with (contact type of charger) or adjacent to (adjacent type of charger) the electrophotographic photosensitive member.

In this image forming apparatus, by the electric charging member contacting with or placing close to the electrophotographic photosensitive member, the generations of ozone, nitrogen oxides and the like can be dccreased. And the electrophotograghic photosensitive member used for such kind of image forming apparatus becomes excellent in anti-abrasion nature, therefore if the electric charging member is used in a contacted state with the electrophotograghic photosensitive member, the suface abrasion of the the electrophotograghic photosensitive member can be suppressed in a small degree.

Further, pursuant to the present invention, there is provided an image forming apparatus according to aforementioned image forming apparatus, wherein the toner imagc-receiving mean is an intermediate transfer medium, toner images developed on the plurality of electorophotographic photosensitive members are firstly transferred to form over-laid images on the intermediate transfer medium one by one, and thereafter the over-laid images on the intermediate transfer medium are, put together, and at once, secondary transferred onto a recording member.

This indirect transfer system has an advantage that the location for the secondary transfer can, relatively freely, be established, in comparison with for example the direct transfer system in which the toner image is transferred from photosensitive member to the recording member directly, thus sizing down of the apparatus can be designed.

Further, pursuant to the present invention, there is provided an image forming apparatus according to aforementioned image forming apparatus, wherein the toner image-receiving mean is an intermediate transfer medium, and the intermediate transfer medium is an elastic seamless belt constituted by an elastic material in the whole of it or at least one layer thereof.

In general, the color images are composed from four toners, and each toner being colored by respective own coloring agent. And one to four toner layers are formed for one color image. Pressures are given to the each toner layer in the courses of the first transfer operation to transfer the toner from the developed photosensitive member to the intermediate transfer belt, and the second transfer operation to transfer the toner on the intermediate transfer belt to the image recording sheet. Thus the aggregation force between toner particles is enhanced. The enhanced aggregation force between toner particles is apt to cause an interim void in letter image and a void induced by edge effect in solid image. In particular, the resin belts having been used hitherto possess a high hardness, accordingly does not transform pursuant to the existing toner layers, therefore is apt to compress the toner layer hence is apt to occur the inside dropout in letter image. And a requirement for forming the full-color image on various papers for instances Japanese paper or artificially embossed paper has been growing larger. However the paper having an inferior evenness surface is likely to occur the air-gaps between its surface and toner layer, hence is apt to occur an interim void caused with transfer in letter image. If increasing the transfer pressure at second transfer section for the purpose of increasing the fitness contact, it results an enhanced aggregation of toner layer, hence causes aforementioned interim void in letter image.

In the image forming apparatus of the present invention, the intermediate transfer medium is an elastic belt, the elastic belt has lower hardness in comparison with the resin belt, thus is transformed pursuant to toner layer and inferior evenness paper. Namely aforementioned elastic belt is tamed to local unevenness to transform, therefore can obtain a fitness contact without elevating the pressure for transfer the toner layer. By this feature, a transferred image having no interim void of letter image, and an excellent uniformity even if for a paper of unevenness surface can be obtain.

Further, pursuant to the present invention, there is provided an apparatus according to the aforementioned apparatus, wherein the intermediate transfer medium has a hardness(HS) by J I S(Japanese Industrial Standard)—A in the range 10° to 65°.

A hardness less than 10° of the intermediate transfer medium causes a significant difficulty to form itself with a high dimensional precision. This is caused by a nature easily influenced from shrinkage and expansion. And if wanted to be soften, an addition of oily component to the base material is a general processing, however this processing has a drawback that the oily component is oozed out by continues operation under the pressure. It becomes clear by our studies that if aforementioned oily component adhere, makes traversal strap blurring. In general, a surface layer has been provided to improve the repellency of the photosensitive member surface, but the entire prevention of the ooze out of the oily component must depend on the employment of a surface layer having high quality such as excellent durability for chemicals and the like, hence the qualification and the selection of characteristics of the material to be used becomes difficult.

On the other hand, if the hardness of the intermediate transfer medium exceeds 65°, then the increase in the hardness causes a higher dimensional precision of the formed one, and moreover, the decreased or eliminated addition of the oily component become possible. This means that the adhesion of the oily component to the photosensitive member can be decrease, however the improvements of the transfer nature such as a decrease of the interim void of letter image and so forth become impossible. And in case of a large excess hardness, thus the intermediate transfer must hardly pass over between tension rollers. In the apparatus in the present invention, the hardness of the intermediate transfer medium has the hardness ranging 10° to 65°, therefore is no oozing out of the oily component in the continuos operation under the pressure, thus occurring no adhesion of the oily component to the photosensitive member, hence is no adhere of oily component, and makes no blurring strap in traversal direction. Further the improvements of the transfer nature such as a decrease of the interim void of letter image and so forth can be improved, and the intermediate transfer can be easily hardly passed over between the tension rollers.

Furthermore, pursuant to the present invention, there is provided an apparatus according to the aforementioned apparatus, wherein the intermediate transfer medium has a wick layer.

In case intermediate transfer medium made by an elastic belt, when the elastic belt is passed over between tension rollers, it causes an elastic deformation, thus it is easily expanded particularly to the circumference direction. The stretched intermediate transfer medium to the circumference direction causes a position shift of the colors being overlaid at the first transfer action. In the apparatus of the present invention, the wick layer in intermediate transfer medium prevents the elastic deformation of the expansion to the circumference direction, thus can accurately concords with the positions of overlaid colors, and can evade a distortion in obtained image.

Furthermore, pursuant to the present invention, there is provided a process cartridge used in image forming process, wherein the process cartridge is equipped with aforementioned electrophotographic photosensitive member.

The process cartridge of the present invention is a small abrasive of the surface of electrophotographic photosensitive member, and can prevent the generation of image drifting and image blurring for long period of use time.

DETAILED DESCRIPTION OF THE INVENTION

Figure 1:
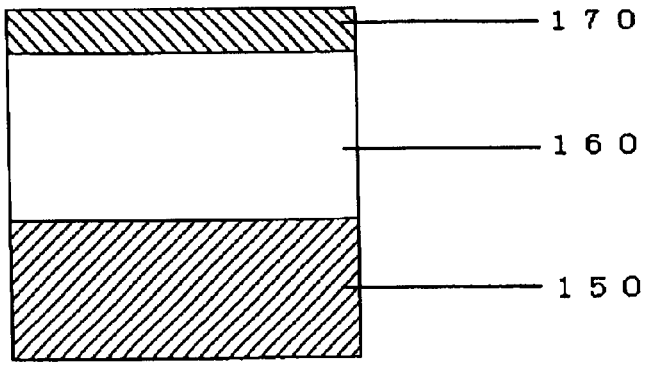
FIG. 1 is a schematic view illustrating the cross section of an embodiment of the electrophotographic photosensitive member of the present invention.

Aforementioned and other objects, features and attendant advantages of the present invention will become apparent upon the consideration of the following description in connection with the accompanying drawings in which like reference characters designate like corresponding parts throughout.

Figure 2:
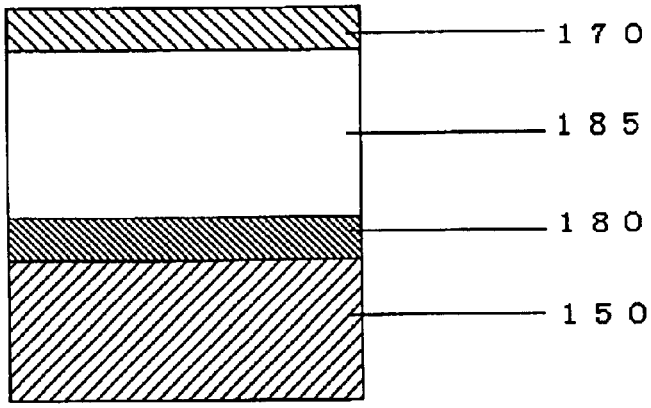
FIG. 2 is a schematic view illustrating the cross section of another embodiment of the electrophotographic photosensitive member of the present invention.
Figure 3:
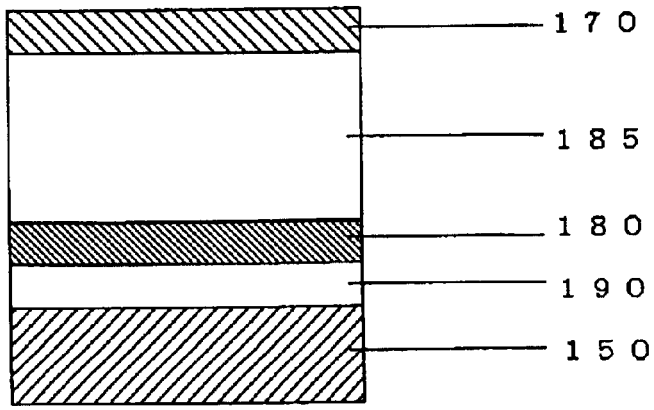
FIG. 3 is a schematic view illustrating the cross section of still another embodiment of the electrophotographic photosensitive member of the present invention.

FIG. 1 is a schematic view illustrating the cross section of an embodiment of the electrophotographic photosensitive member of the present invention, and shows an electrophotographic photosensitive member of having a structure consisting of a photosensitive layer 160 provided on an electric conductive supporting substrate 150, and a protection layer provided on the photosensitive layer 160. FIGS. 2 and 3 show other embodiments of the electrophotographic photosensitive member of the present invention, FIG. 2 shows a function-sharing type of electrophotographic photosensitive member having a photosensitive layer consisting of a CGL 180 and CTL 185, and FIG. 3 shows an electrophotographic photosensitive member having an under coat layer 190 between the electric conductive supporting substrate 150 and CTL 185. Further, the electrophotographic photosensitive member of the present invention is allowed to be other structure than aforementioned structures, as far as it has at least the photosensitive layer and the protection layer on the electroconductive supporting substrate. And the type of the protection layer may be various kinds or in combinations.

The electroconductive supporting substrate 150 used for the electrophotographic photosensitive member of the present invention may be included an electroconductive substrate, or an insulating substrate. For examples metal substrates such as Al, Ni, Cu, Au, metal alloy thereof and so forth, insulating substrates such as poly carbonate, poly imide, glass and the like which have a thin layer of electroconductive material such as metal material such as Al, Ag, Au or metal compound material such as $In_2O_3$, $SnO_2$ and the like, paper treated by electroconductive material are instanced. There is no restriction in the shape of the conductive supporting substrate, thus any shape of substrate such as sheet or plate form, belt form, drum form, and the like can be used, however some particular cases having belt shape structure are not favorable, because if the supporting substrate is a such belt shape structure, the apparatus becomes complicated with the necessity to provide a drive roller and a follower roller and so forth, hence it causes unfavorable larger dimension in the configuration of apparatus. And in case of belt shape, there is a possibility that the flexibility of the protection layer become insufficient, and as a result, there is a possibility to occur a flaw called crack on the surface, and the crack causes a color stain. By this reason, as the supporting substrate, a drum shape of substrate having a high rigidity is favorably used.

If necessary, an under coat layer 190 can be provided between the conductive supporting substrate and the photosensitive layer. Such under coat layer is provided for improving the adhesive property, for preventing moier in the resultant image, for improving coating quality of the upper photosensitive layer. The under coat layer 190 mainly includes a resin. Since the photosensitive layer coating liquid, which typically includes an organic solvent, is coated on the under coat layer, the resin used in such the under coat layer preferably has a good resistance to popular organic solvents.

Specific examples of such resins for use in the under coat layer include water-soluble resins such as polyvinyl alcohol, casein and sodium polyacrylate; alcohol-soluble resin such as nylon copolymer, and methoxymethylated nylon; and crossrinkable resins which forms a three dimensional network, such as polyurethane resin, melamine resin, alkid-melamine resin, epoxy resin and the like.

In addition, the under coat layer 190 may include a fine power of metal oxides such as titanium dioxide, silica, alumina, zirconium oxide, tin oxide, indium oxide, metal sulfides, and metal nitrides. When the under coat layer 190 is formed using these materials, known coating methods using a proper solvent can be used.

Further, as such under coat layer, is useful which having a metal oxide layer which is formed, for cxamplc, by a sol-gel method using silane coupling agent, titanium coupling agent or chromium coupling agent.

In addition that, an under coat layer made from an organic compound such as polyparaxylene or an inorganic compound such as $SnO_2$, $TiO_2$, ITO film and $CeO_2$, which are formed by a vacuum film forming method, can also be favorably used as the under coat layer.

The thickness of the under coat layer 190 is preferably from 0.1 to 5 $\mu$m.

Specific examples of the inorganic charge generating materials include crystalline selenium, amorphous selenium, selenium-tellurium alloy, selenium-tellurium-halogen alloy, seleniun-arsenic alloy and amorphous silicon. Suitable amorphous silicon includes ones in which a dangling bond is terminated with a hydrogen atom or a halogen atom, or in which a boron atom or a phosphorous atom is doped.

With regard to the photosensitive member (which may be described hereinafter as photoreceptor) of the present invention, the photoreceptor may be constituted by single layer or by overlaid plural layers, however hereinafter, the explanation is made with the overlaid layers type, which being provided on the supporting substrate 150 through aforementioned under coat layer 190, a detailed representation will be explained. In the photoreceptor, the photosensitive layer having a charge generating layer abbreviated as CGL 190 and a charge transfer layer abbreviated as CTL 185 can be favorably used. At first, the CGL is mainly constituted of a charge generating material, and optionally includes a binder resin. As the photosensitive material, an inorganic photoconductive material such as selenium type of photoconductive material and organic photoconductive (OPC) material can be used.

Specific examples of the organic charge generating materials include phthalocyanine pigment, such as metal phthalocyanine and metal-free phthalocyanine, azulenium pigment, squaric acid pigment, azo pigment having a carbazol skelton, azopigment having a triphenylamine skelton, azopigment having a diphenylamine skelton, azo pigment having a dibenzothiophene skelton, azo pignent having a fluorenone skelton, azo pigment having an oxadiazole skelton, azo pigment having a bisstilbene skelton, azo pigment having a distyryloxadiazole akelton, azo pigment having a distyrylcarbazole skelton, perylene pigment, anlhraquinone pigment, polycyclic quinone pigment, quinoeimine pigment, diphenylmethane pigment, triphenylmetane pigment, benzoquinone pigment, naphthoquinone pigment, cyanine pigment, azomethine pigment, indigoid pigment, bisbenzimidazole pigment and the like materials. These charge transfer materials can be used alone or in combination.

Specific examples of the binder resin for use in the CGL 180, which is optionally used in the CGL 180, include polyamide resin, polyurethane resin, epoxy resin, polyketone resin, polycarbonate resin, silicone resin, acrylic resin, polyvinylbutyral resin, polyvinylformal resin, polyvinylketone, polystyrene, poly-N-vinylcarbazol resin polyacrylamide resin and the like resin. These resins can be used alone or in combination.

One or more charge transfer materials may be included in the CGL 180, if desired. In addition, one or charge transport polymer materials an be used as a binder resin of the CGL 180.

Suitable methods for forming the CGL 180 include thin layer film forming methods in a vacuum, and casting methods using dispersion liquids.

Specific examples of such thin layer forming methods in a vacuum include vacuum evaporation method, glow discharge decomposition method, chemical vapor deposition method, chemical vapor deposition (CVD) method, sputtering method, reactive sputtering method, ion plating method, accelerated ion injection method. A layer of the above mentioned inorganic and organic materials can be formed by one of these vacuum methods.

The latter namely casting methods useful for forming the CGL 180 include, for example following steps comprising of (i) step of preparing coating liquid by mixing one or more inorganic or organic charge generating materials described above with a solvent such as tetrahydrofuran, cyclohexanone, dioxane, dichloroethane, buthanone and the like, and if necessary, together with a binder resin and an additive, and then dispersing the materials with a ball mill, an attritor, a sand mill or the like, (ii) step of coating thus obtained coating liquid on a supporting substrate, which liquid is diluted if necessary, by a dip coating method, a spray coating method, a beads coating method and the like, and (iii) step of drying the coated liquid to form a CGL.

The thickness of the obtained CGL 180 is favorably from about 0.01 to about 5 $\mu$m , and more favorably from about 0.05 to about 2 $\mu$m.

Next, the CTL (charge transfer layer) 185 will be explained in detail. The function of the CTL 185 is to retain charges formed on the photosensitive layer, and to pass through the carriers, which are selectively generated in the CGL 180 by irradiating the photosensitive layer with image wise light exposure, to couple the charges with the carriers on the photosensitive layer, resulting in formation of an electrostatic latent image on the surface of the photoreceptor. Therefore, the CTL 185 preferably has a high electric resistance to retain charges, and a small dielectric constant and large charge mobility to obtain a high surface potential at the charges retained on the photosensitive layer.

In order to satisfy such requirements, the CTL 185 is mainly constituted of a charge transfer material together with a binder resin which is used if necessary. The CTL 185 is typically prepared by foe example a method comprising steps of (i) dissolving a charge transport material, and a properly resin and an additive if desired to prepare a coating liquid; and (ii) coating the coating liquid, for example on the CGL 180, (iii)then drying the coated liquid, resulting the CTL. The CTL 180 may include additives such as a plasticizer, an antioxidant, a leveling agent and so forth, in an properly amount, other than the charge transfer material and the binder resin.

The charge transfer materials are classified into positive hole transfer materials and electron transfer materials. Specific examples of the electron transfer materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transfer materials can be used alone or in combination.

Specific examples of the positive hole transfer materials include electron donating materials such as oxazole derivatives, oxadiazole derivatives, imidazole derivatives, triphenylamine derivatives, 9-(p-diethylamino-styrylanthracene), 1,1-bis(4-dibenzylaminophenyl) propane-, styrylanthracene, styrylpyrazoline, phenylhydrazone compounds, a-phenylstilbene derivatives, thiazole derivatives, phenazine derivatives, acridine derivatives, benzofuran derivatives, benzimidazole derivatives, thiophene derivatives, and the like materials. These positive hole transfer materials can be used alone or in combination.

As the charge transfer polymer material, following charge transfer polymer materials (i.e., polymers having an electron donating group) can be used:

(a) Polymers having a carbazole ring in their main chain and/or side chain.

Specific examples of such polymers include poly-N-vinyl carbazole, and compounds disclosed in Japanese Laid-Open Patent Publications Nos. Tokkai shou 50-82056, 54-9632, 54-11737, Tokkai hei 4-175337, 4-183719 and 6-234841.

(b) Polymers having a hydrazone skleton in their main chain and/or side chain.

Specific examples of such polymers include compounds disclosed in Japanese Laid-Open Patent Publications Nos. Tokkai shou 57-78402, 61-20953, 61-296358, Tokkai hei 1-134456, 1-179164, 3-180851, 3-180852, 3-50555, 5-310904 and 6-234840.

(c) Polysilylene compounds.

Specific examples of such polymers include polysilylene compounds disclosed in Japanese Laid-Open Patent Publications Nos. Tokkai shou 63-285552, Tokkai hei 1-88461, 4-264130, 4-264131, 4-264132, 4-264133 and 4-289867.

(d) Polymers having a triaryl amine skeleton in their main chain and/or side chain.

Specific examples of such polymers include N,N-bis(4-methylphenyl)-4-aminopolystyrene, and compounds disclosed in Japanese Laid-Open Patent Publications Nos. Tokkai hei 1-134457, 2-282264, 2-304452, 4-133065, 4-133066, 5-40350.and 5-202135.

(e) Other polymers.

Specific examples of such polymers include condensation products of nitropyrene with formaldehyde, and compounds disclosed in Japanese Laid-Open Patent Publications Nos. Tokkai shou 51-73888, 56-150749, Tokkai hei 6-234836 and 6-234837.

The charge transfer polymer material (the polymer having an electron donating group) for use in the CTL 185 is not limited thereto, and known copolymers (random, block and graft copolymers) of the polymers with one or more known monomers and star polymers can also be used. In addition, crosslinking polymers having an electron donating group disclosed in, for example, Japanese Laid-Open Patent Publication No.Tokkai hei 3-109406 can also be used.

And, polycarbonates, polyurethanes, polyesters and polyethers as charge transfer materials, which have a triaryl amine structure, are preferable. Specific examples of such polymer materials have been disclosed in Japanese Laid-Open Patent Publications Nos. Tokkai shou 64-1728, 64-13061, 64-19049, Tokkai hei 4-11627, 4-225014, 4-230767, 4-320420, 5-232727, 7-56374, 9-127713, 9-222740, 9-265197, 9-211877 and 9-304956.

Resins employable for the CTL include for examples polycarbonate, polyester, methacrylic resin, acrylic resin, polyethylene, polyvinylchloride, polyvinylacetate, polystylene, phenol resin, epoxy resin, polyurethane, polyvinilidenechloride, alkyd resin, silicone resin, polyvinylcarbazole, polyvinylbutyral, polyvinylhormal, polyacrylate, polyacrylamide, phenoxy resin and the like resin. These resins can be used alone or in combination. The thickness of the CTL is preferably from 5 to 100 $\mu$m.

The CTL 185 of the present invention may include additives such as an antioxidant and a plasticizer which are used, for example, in rubbers, plastics, oils and fats.

In addition, the CTL 185 may include a leveling agent. Specific examples of such leveling agents include silicone oils such as dimethyl silicone oils and methylphenyl silicone oils; and polymers and oligomers having a perfluoroalkyl group in their side chain. The content of the leveling agent is from 0 to 1 part by weight per 100 parts by weight of the binder resin included in the CTL 185.

The CTL 185 can be formed by a conventional coating method such as dip coating, spray coating, and beads coating methods.

Next, with regard to the single layer type of the photosensitive layer, the detailed will be explained. With regard to the providing of single photosensitive single layer by the casting method, in many case, such single layer is provided by dissolving or dispersing a charge generating material, and both high molecular and low molecular charge transfer materials to a proper solvent to prepare a coating liquid, and coating the obtained coating liquid onto the supporting substrate, and drying it. As the charge generating material and charge Transfer materials, aforementioned materials can be used.

And, to such single photosensitive layer can be added a plasticizer, if necessary. Further, the binder resin, which can be used if necessary, can be used the these binder resin as it is aforementioned with regarding to the preparation procedure of CTL. Other than that binder resin described with the CTL, binder resins which were mentioned above with the CGL can be mixed.

The thickness of the single photosensitive layer is favorably from 5 $\mu$m to 100 $\mu$m.

The protection layer of the electrophotosensitive member of the present invention contains at least a kind of metal oxide fine particles, a binder resin which is capable of hardening, an organic acid, and is formed by heat-hardening the binder resin, under the presence of an acid.

Specific examples of the metal oxide fine particles include silica, alumina, titanium oxide, zirconium oxide, tin oxide, indium oxide, silicon nitride, which can be used alone or in combinations. The surface of these metal oxide fine particles may be treated with one or more organic materials or inorganic materials to improve their dispersibility in the binder resin used. Titanium dioxide particles treated in their surfaces by silica, alumina or zirconium oxide show an excellent dispensability in other materials used for constituting the protection layer, and a significantly improvement of anti-abrasion nature, hence is used favorably.

As having been described above, by the present invention, there is provided an electrophotographic photosensitive member, wherein the metal oxide fine particles contained in the protection layer are silica, alumina or titanium dioxide. By such construction, an electrophotographic photosensitive member is realized which occurs no reaction between the metal oxide fine particles and the charge transfer material, accordingly, the photosensitive member is difficult to cause black spots which are ordinary caused by the reaction between metal oxide and the charge transfer material, thus, an electrophotographic photosensitive member having excellent anti-abrasion nature can be produced by a lower cost.

It is known from a comparative long time ago that mechanical strength of the resinous compositions are increased by mixing filler particles or fine fragments of fibrous material into the resinous compositions. However, the present invention has special features in combination of employment of special amount of organic acid, and employment of the metal oxide fine particles having an average primary particle size of limited range of 0.01 $\mu$m to 1.0 $\mu$m, favorably 0.05 $\mu$m to 0.5 $\mu$m from the point of total transparencies of photosensitive member containing the transparencies in the protection layer, in the CTL and in the CGL, respectively, and from point of anti- abrasion nature of the protection layer.

If the average primary particle diameter exceeds 0.5 $\mu$m which is approximately half of maximum wave length ($\lambda/2$) of the exposure light emitted from the light source generally used, the transmittances of the light to the inside layers may be interrupted, hence is spoiled in the sensitivity of the photosensitive member. And if average primary particle diameter exceeds 1.0 $\mu$m, in relation with the thickness of the protection layer, there is a possibility to reduce the anti-abrasion nature. In case of the metal oxide fine particles having an average primary particle diameter less than 0.01 $\mu$m, they are expensive, handling thereof becomes difficult, and they are apt to be a cause for black spots, because they have large relative surfaces, hence might be too active, therefore acting as generation factor of black spots.

Figure 15:
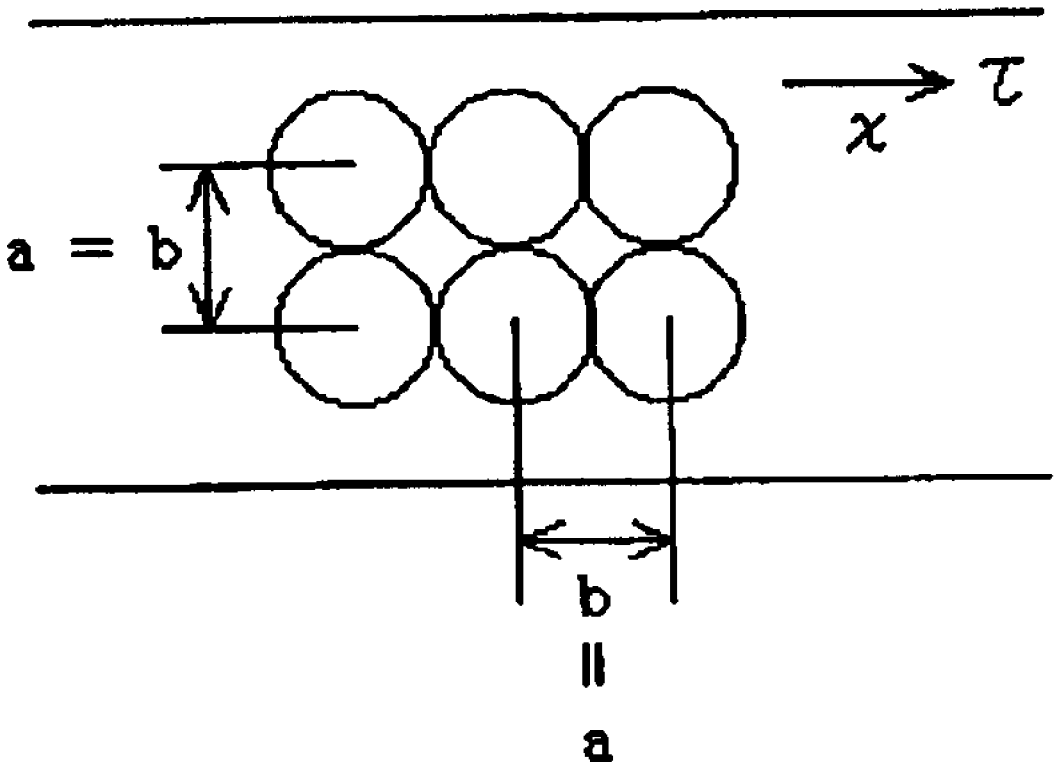
FIG. 15 is a schematic view illustrating a hypothetical action of metal oxide particles contained in the protection layer of the electrophotographic photosensitive member of the present invention.

With regard to the transformation of a layer structure consisting of aggregates of fine particles, in general, in the solid structure of materials for example thin layer structure consisting of a number of fine particles, or thin layer structure consisted of a plurality of two sub-layers and each layer is filled up with fine particles, a consideration for a stress to transform therein can be made as follow. As shown in FIG. 15, in virtual face positioned in a level occurring a shearing between upper and lower sub-layers in the structure which is consisted by a plurality of layer structures and each layer is consisted by the filled up fine particles, a stress ($\tau$) to transform the structure at a horizontal virtual face, namely, a stress ($\tau$) to shear the upper layer with a small length (x) from the lower layer, can simplify, and be represented by a periodic function of the distance (b) between the particles, and can be represented by an Equation of $\tau=k \sin(2\pi x/b)$, wherein (k) is a constant.

"The distance (b) between the particles" is a distance between a particle and adjacent particle, namely it is center-to-center spacing, and if these particles are same in size, the distance (b) is equal to the particle diameter. This relation is applicable to the vertical left and right layers divided by a vertical virtual face.

Where the (x) is small enough, Hooke's law is applicable, therefore an Equation of $\tau=\mu\ (x/b)$ can be approval. And in the aforementioned Equation of $\tau=k \sin(2\pi x/b)$, if the shear (t) is small enough in comparison with the distance (b) or (a), that is a=b, above Equation is $\tau \sim k=\sin(2\pi x/b)$, where the ($\mu$) represents a modulus of rigidity, the ($\tau$) is a stress to shear the upper layer with a small length (x) from the lower layer, (a) and (b) is a distance between particles and is a diameter of the particle (Naohiro Igata[knowledge of materials strength] the Baifukan publishing Co., pp 38 (Jan. 20, 1983).

Namely, in general, the stress ($\tau$) required to shear is in inverse proportion with the distance (a) of particles, and diameter (b) of the particle. In other words, solid material consisting of smaller particles is more difficult to shear.

On the other hand, there is another teaching in connection with the inside movement of the particle in a solid material which is filled up by a number of fine particles, so-called Hall-Petch's Relational Expression.

This Hall-Petch's Relational Expression says that the relationship between the stress ($\sigma_y$) required for causing an inner transition of the particles, initial abrasion strength ($\sigma_o$) of particles, and the diameter (d) of the particles is represented by an Equation of $\sigma_y=\sigma_o+K_y\ d^{-1/2}$, where the ($k_y$) is a constant which depends on temperature. This Equation means that the stress ($\sigma_y$) required for the inner transition of the particles is depend on the square root of the diameter (d) of the particle.

By the basis of the Hall-Petch's Relational Expression, the stress ($\sigma_y$) required for the inner transition of the particles is depend on initial abrasion strength ($\sigma_o$) of particles, constant ($k_y$), and diameter of the particle(d), anyway, a solid structure formed by filled up smaller particles is more difficult to make structural transition by a constant shearing power.

And, there is a shown fact in the present invention that the protection layer in the present invention, in case of containing a fine and a limited scope of size distribution of metal oxide particles, shows an excellent durability. That fact of the present invention is concordance with above described known theories.

The amount of these metal oxides fine particles is favorably 10 to 200 wt. % for the resin amount. If the amount of these metal oxides fine particles less than 10 wt. %, there is a possibility that an excellent anti-abrasion nature is not obtained. Amount more than 200 wt. % causes a reduction of volume rcsistivity thus can not hold the electric potential of the protection layer surface, causing inferior image such as image drifting and image blurring.

Specific examples of the curable resin include, for examples, urethane resin, melamine resin, guanamine resin, alkid resin, phenol resin, acrylic resin, and the like resins. These arc used alone or in combination, and are favorably used in the mixture of more than 2 kinds thereof. Particularly, the anti-abrasion nature of the obtained protection layer can be significantly improved by thermo-setting a mixture of acrylic resin having a property to make a three dimensional network structure by cross-linking reaction, and a melamine resin and/or a benzo-quanamine resin. It is desirable to optimize the mixing ratio of with consideration of the anti-abrasion nature of the protection layer, the dispersing stability of the matallic oxides fine particles and the hardness of the resin and so forth, with consideration of the anti-abrasion nature of the protection layer, the dispersing stability of the matallic oxides fine particles and the hardness of the resin and so forth, the range from about 9/1 to about 4/6 by weight ratio is favorable.

The protection layer may further include a small amount of charge transfer material, and thereby the residual electric potential caused by the repeated use of the electrophotographic photosensitive member, and thus caused degradation of image quality can be suppressed. Such charge transfer materials may be aforementioned materials in the paragraphs of the CTL. However it is favorable to select the charge transfer materials, with consideration of the compatibility with the thermo-setting resin and so forth. The thermo-setting resin consisting of the acrylic resin, and the melamine resin and/or the benzo-quanamine resin in the present invention are very excellent in the compatibility with the charge transfer material, therefore can form the protection layer having high transparency, hence favorable.

The amount of charge transfer material used in the protection layer is favorably in the ratio range form 3/1 to 1/3 by weight, for the binder resin amount, from a viewpoint of the anti-abrasion nature and electric characteristics.

Organic acid being contained in the protection layer of the present invention is favorably a acid having a catalystic effect promoting the hardening reaction of the used curable resin, and an effect causing a proper reduction of volume resistivity of the protection layer. Specific examples of such kind of organic acid include maleic acid, tartaric acid, citric acid, succinic acid, sufonic acid and the like acids, and derivatives thereof. As aforementioned, inorganic acid is expected as an effect for hardening the used binder resin, however has an inferior solubility in the coating liquid and a inferior compatibility with the resin, hence unfavorable to make contained the resin. In particularly, there are many commercially available sulfonic acids or their derivatives which are varied in kinds and characteristics, and are not expensive and can be handled easy, hence is favorably used. Specific examples of such sulfonic acid include benzene-sulfonic acid, para- toluene-sulfonic acid, 2-naphthalene-sulfonic acid, dodecyl benzene-sulfonic acid, dinonyl benzene-sulfonic acid, dinonyl naphthalene-sulfonic acid, dinonyl naphthalene-disulfonic acid, anthraquinone-1,5-disulfonic acid, anthraquinone-2,6-disulfonic acid, anthraquinone-2-sulfonic acid. And derivatives thereof such as sulfonic acid esters thereof, the sulfonic amides thereof, sulfonic acid halides can be employed.

Among these acidic compounds, a kind of compounds having an acid value of 60 to 150 has a high catalystic effect, and promotes the curing reaction of the resin, and can properly reduce the volume resistivity of the protection layer, hence preferable. As specific examples of the reagents to satisfy those requirements, Catalyst 4040, Catalyst 4050, Catalyst 600 by MITSUI CYTEC LTD. and the likes are instanced. These reagents are safety and can be handled easy, hence favorable.

With regard to the protection layer in the electrophotographic photosensitive member of the present invention, the curable resin which is a binder resin for the protection layer is heat cured under the presence of the organic acid, thereby the organic acid acts as a catalyst, thus curing is progressed at low temperature in a short time, hence the energy consumption in the curing course can be suppress in a lower level, thus it is advantageous from both points of energy saving and enviromental preservation. In particularly, aromatic sulfonic acid has a high efficiency as a catalyst, and is more favorably used.

Further, to the protection layer of the electorophotographic photosensitive member of the present invention can be allowed to add various additives, for improving the adhesive nature, evenness, chemical stability.

The protection layer of the electorophotographic photosensitive member of the present invention may be prepared by coating the coating liquid for forming the protection layer, onto the photosensitive layer being provided on a conductive supporting substrate, then drying the coated liquid by heating, and curing the resin in the coated layer.

Such coating liquid for forming the protection layer is a mixture formed from, and containing, aforementioned resin, the metal oxides fine particles, the acid catalyst, the charge transfer material which is added if necessary, and other additives. The coating liquid for forming the protection layer can be prepared by (i) mixing above mentioned components and an adequate amount of solvent, (ii) and dispersing the obtained mixture using a ball mill, a roll mill, an attritor, a sand mill or the like.

Thus obtained coating liquid for forming the protection layer is coated onto the photosensitive layer by a dip coating method, a spray coating method, a blade coating method, a knife coating method and the like, and then by heat drying and curing to prepare the protection layer. The spray coating method is advantageous from points of mass-productivity and the quality of the coated layer, because especially, this coating method causes no immersion of the solvent of the coating liquid for protection layer, into the photosensitive layer which being placed under the protection layer. And the method can prepare a relatively thin layer.

In addition, For implementing the spray coating, a solid amount contained in the coating liquid for forming the protection layer is favorably 0.5 wt. % to 30 wt. %. If the solid content is less than 0.5 wt. %, for the purpose of obtaining desired thickness of the protection layer, the solvent amount required is increased, hence causing the drawbacks of cost escalation and environmental preservation problem. And, If the solid content is more than 30 wt. %, there are possibilities that foams are apt to contained in the coated layer, or causing an insufficient leveling of coated layer, decreasing the quality of the coated layer, reducing the productivity of good quality item. The thickness of the protection layer in the range from 0.1 to 10 $\mu$m is favorable.

Thus obtained electrophotographic photosensitive member of the present invention may have various layer configurations.

For example as shown in FIG. 1, the electrophotographic photosensitive member of the present invention may have three layers configuration. Namely, in the electrophotographic photosensitive member having three layers configuration, a photosensitive layer 160 is formed on a conductive supporting substrate 150, and a protection layer 170 is formed on the photosensitive layer 160.

As another example of the electrophotographic photosensitive member of the present invention, an electrophotographic photosensitive member as shown in FIG. 2 can be instanced. Namely, the electrophotographic photosensitive member has four layers configuration. In the electrophotographic photosensitive member, a CGL 180 is formed on a conductive supporting substrate 150, a CTL 185 is formed on the CGL 180, and a protection layer 170 is formed on the CTL 185.

As still another example of the electrophotographic photosensitive member of the present invention, an electrophotographic photosensitive member as shown in FIG. 3 can be instanced. Namely, the electrophotographic photosensitive member has five layers configuration. In the electrophotographic photosensitive member, an under coat layer 190 is formed between a conductive supporting substrate 150 and a CGL 180, further a CTL 185 is formed on the CGL 180, and a protection layer 170 is formed on the CTL 185.

Figure 4:
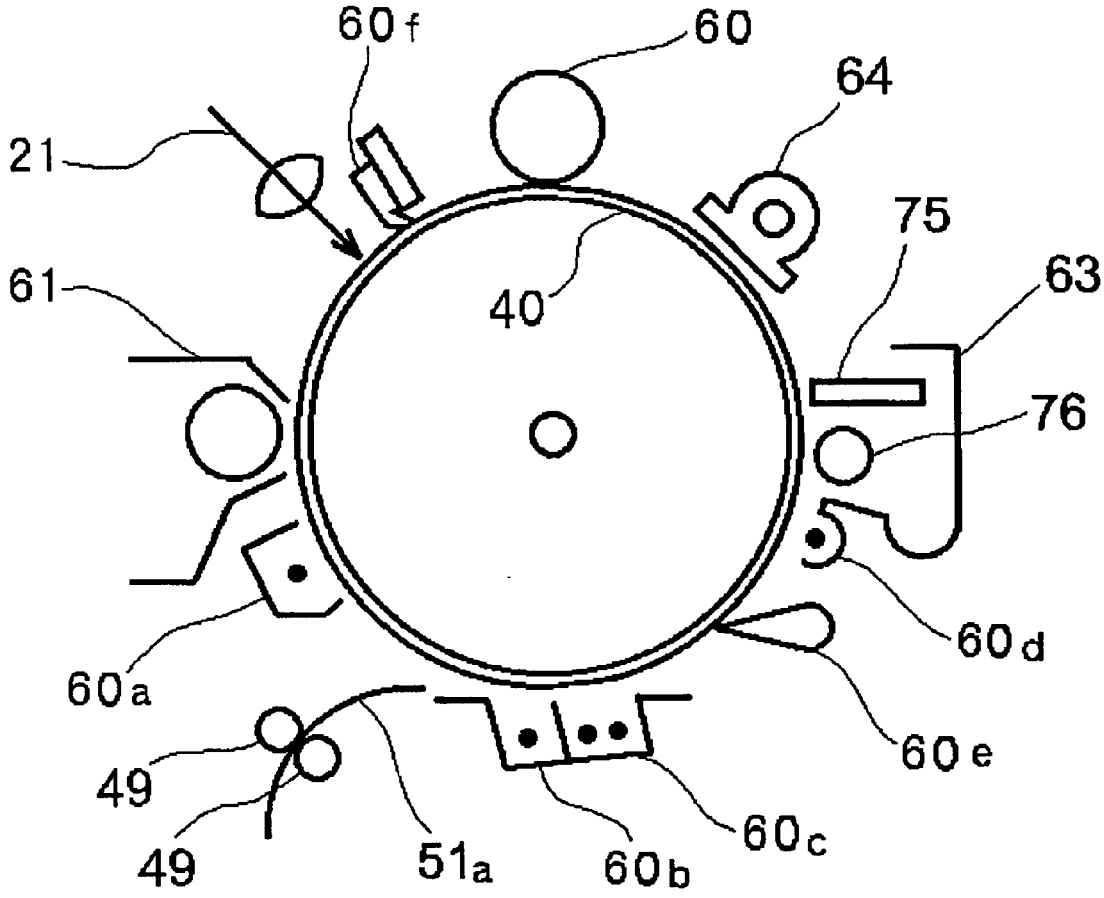
FIG. 4 is a schematic view illustrating the cross section of an embodiment of the image forming apparatus of the present invention.

Preferred embodiments of the image forming apparatus in accordance with the present invention will be described hereinafter with reference to the accompanying drawings. With regard to the image forming apparatus of the present invention, FIG. 4 is a schematic view for explaining the first embodiment of the image forming apparatus of the present invention. The modified embodiments mentioned below are also included in the present invention.

Image Forming Apparatus

The first embodiment of the image forming apparatus of the present invention will be explained in detail referring to drawings.

Figure 7:
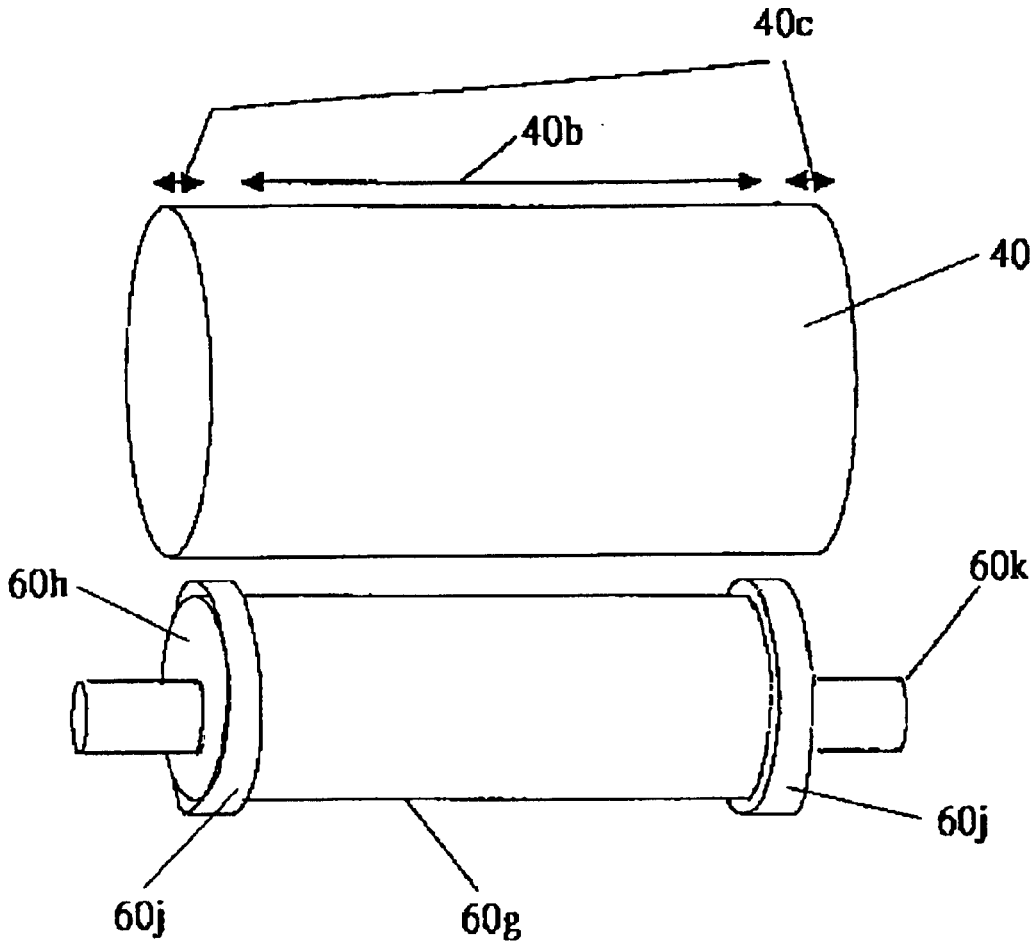
FIG. 7 is a schematic view illustrating the cross section of an embodiment of a non contact type of electric charging mean used in the image forming apparatus of the present invention.

In FIG. 4, a drum type of photoreceptor, that is electrophotographic photosensitive member, 40 includes at least a photosensitive layer formed on an electroconductive supporting substrate. In this case, the photoreceptor 40 serves as an image bearing device. The photoreceptor 40 has a drum shape, but sheet photoreceptors or endless belt photoreceptors can also be used as mentioned below. A charging roller 60 as an embodiment of charging apparatus is used for charging the photoreceptor 40. The structure of the charging roller 60 and the configuration of the charging roller 60 and the photoreceptor 40 are those as shown in FIG. 7. When charging the photoreceptor 40, it is preferable that a DC voltage overlapped with an AC voltage is applied to the photoreceptor 40 by the charging roller 60, to uniformly charge the photoreceptor 40.

Around the photoreceptor 40, a discharger 64, the charging roller 60, an eraser 60*f*, an imagewise light irradiator 21, a developing device 61, a pre-transfer charger 60*a*, a transfer charger 60*b*, a separation charger 60*c*, a separation pick 60*e*, and a cleaning unit 63 including a pre-cleaning charger 60*d*, a cleaning brush 76 and a cleaning blade 75 are arranged while contacting or being set closely to the photoreceptor. The toner image formed on the photoreceptor 40 is transferred onto a receiving paper 51*a* fed by a pair of registration rollers 49 to the transfer charger 60*b*. The receiving paper 51*a* having the toner image thereon is separated from the photoreceptor 40 by the separating pick 60*e*.

In the image forming apparatus of the present invention, known charging devices such as corotrons, scorotrons, solid state chargers and charging rollers are used for the pre-transfer charger 60*a*, and the pre-cleaning charger 60*d*.

As the transfer device, the above-mentioned chargers can be used. The transfer method using a combined device the transfer charger 60*b* and the separation charger 60*c*, as shown in FIG. 4 can also preferably used.

Suitable light sources for use in the imagewise light irradiating device 21 and the discharger light 64 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The above-mentioned lamps can be used for not only the processes mentioned above and illustrated in FIG. 4, but also other processes using light irradiation, such as a transfer process including light irradiation, a discharging process, a cleaning process including light irradiation and a pre-exposure process.

When the toner image formed on the photoreceptor 40 by the developing unit 61 is transferred onto the receiving paper 51*a*, all of the toner image are not transferred on the receiving paper 51*a*, and residual toner particles remain on the surface of the photoreceptor 40. The residual toner is removed from the photoreceptor 40 by the fur blush 76 and the cleaning blade 75. The residual toner remaining on the photoreceptor 40 can be removed by only a cleaning brush. Suitable cleaning blushes include known cleaning blushes such as fur blushes and mag-fur blushes.

When the photoreceptor 40 which is previously charged positively (or negatively) is exposed to imagewise light, an electrostatic latent image having a positive or negative charge is formed on the photoreceptor 40. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

As the developing device 61, known developing devices can be used. In addition, as the discharger 64, known discharging devices can also be used.

Figure 5:
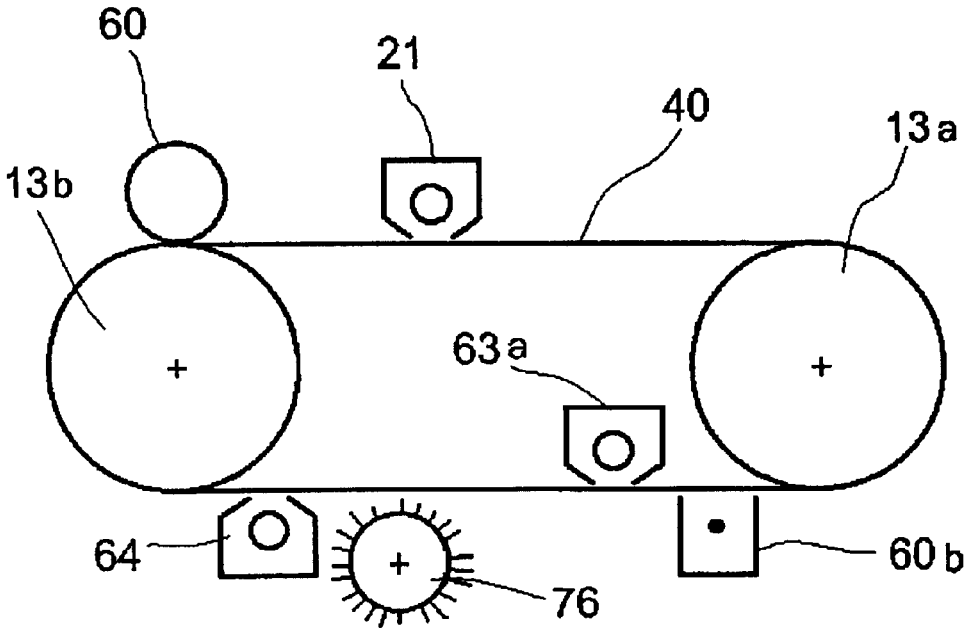
FIG. 5 is a schematic view illustrating the cross section of another embodiment of the image forming apparatus of the present invention.

FIG. 5 is a schematic view illustrating another example of the first embodiment of the image forming apparatus of the present invention. A photoreceptor 40 as an electrophotographic photosensitive member includes at least an electroconductive supporting substrate and a photosensitive layer formed thereon. The photoreceptor 40 has such a structure as shown in FIGS. 1 to 3. The photoreceptor 40 is rotated by driving and driven rollers 13*a* and 13*b*, and repeatedly subjected to a charging process using a charging roller 60, an imagewise irradiation process using a light source 21, a developing process using an image developer (not shown), a transfer process using a charger 60*b*, a pre-cleaning irradiation using a light source 63*a*, and a discharging irradiation using a light source 64. In this case, the photoreceptor 40, the driving and driven rollers 13*a* and 13*b* serve as the image bearing device. In FIG. 5, imagewise irradiation is performed to the photoreceptor 40 from the substrate side thereof. In this case, the substrate is light transmissive.

The above-mentioned image forming apparatus is an example of the embodiment of the image forming apparatus of the present invention. The image forming apparatus of the present invention is not limited to the image forming apparatus as shown in FIG. 5. For example, although the pre-cleaning light irradiating operation can be performed from the substrate side of the photoreceptor 40 in FIG. 5, the operation may performed from the photosensitive layer side of the photoreceptor 40. In addition, the light irradiation in the imagewise irradiation process and the discharging process may be performed from the substrate side of the photorceeptor 40.

As the light irradiation processes, the imagewise irradiation process, pre-cleaning irradiation process, and discharging process are illustrated in FIG. 5. In addition, the photoreceptor 40 may also be subjected to a pre-transfer light irradiation process, which is performed before the transfer of the toner image, and a preliminary light irradiation process, which is performed before the imagewise irradiation process, and other light irradiation processes.

The above-mentioned image forming unit may be fixedly set in a copier, a facsimile or a printer. However, the image forming unit may be set therein as a process cartridge. The process cartridge is an image forming unit (or device) which includes a photoreceptor, a housing and at least one of a charger, an imagewise light irradiator, an image developer, an image transferer, a cleaner, and a discharger. The process cartridge of the present invention includes at least a photoreceptor, and a charger.

Figure 6:
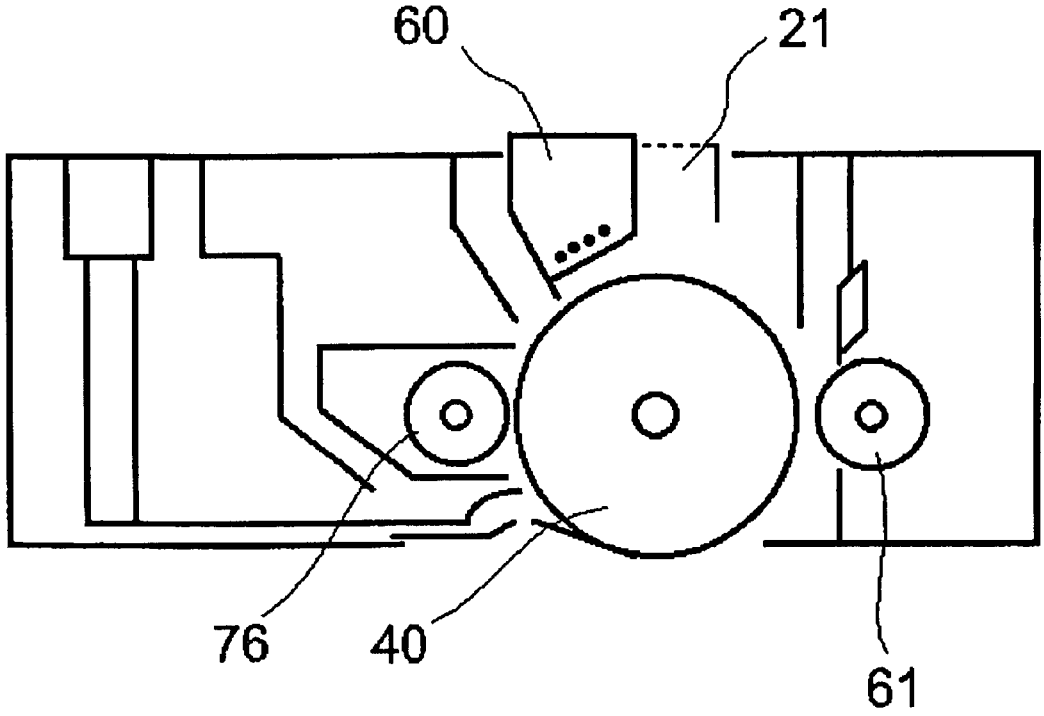
FIG. 6 is a schematic view illustrating the cross section of an embodiment of the process cartridge of present invention which is mounted on the image forming apparatus.

Various process cartridges can be used in the present invention. FIG. 6 is a schematic view illustrating an embodiment of the process cartridge of the present invention. FIG. 6, the process cartridge includes a photoreceptor 40 and a charger 60, an imagewise light irradiator 21, a developing roller 61, and a cleaning brush 76, which are arranged around the photoreceptor 40. In this case, the photoreceptor 40 serves as the image bearing device. The photoreceptor 40 has at least an electrographic photosensitive member having photosensitive layer formed on an electroconductive supporting substrate, which is also called as photoreceptor here, formed by the present invention.

The contact type of charger described here is a charger which is contacted the surface thereof with the surface of the electrophpotographic photosensitive member, charger roller, charger blade, charger brush are instanced. Among these, charger roller, charger brush types are favorably used.

And, the adjacent type of charger described here is a charger which is placed close to, but not contacted with, the surface of electrophotographic photosensitive member. It holds a gap less than or equal about 200 $\mu$m between the surface thereof and the surface of electrophotographic photosensitive member, therefore it is distinguished from known charger such as corotrons, scorotrons. The adjacent type of charger used in the present invention may be any shape of charger, as far as it can control the proper gap between the surface thereof and the surface of electrophotographic photosensitive member. For example, an arrangement may be allowed in which the rotation axis of the photosensitive member is mechanically fixed with the rotation axis of the charger so as to hold the proper gap between them. Especially, roller shape of charger is employed, and gape forming members are provided at both side ends of the charger which are faced parts to the both side end zones in the surface of the photosensitive member in where no image is formed, and only the gape forming members are contacted with the surface of the photosensitive member, but it does not contact with image forming area of the surface of the photosensitive member, alternatively, the gape forming members can be provided at both side ends of the photosensitive member, so as to contact only the gape forming members, with both side ends of the charger, and does not make contact the image forming area, with the surface of the charger. These are simple method and are method capable of keeping the gap stable. FIG. 7 shows an example of the adjacent type of charger in which gap forming members are provided to the charger.

FIG. 7 is a schematic view illustrating an embodiment of configuration of a charger roller 60*g* and a photoreceptor 40. Flanges 60*h* are provided to both side openings of the charger roller 60*g*, and strap shape of gap forming members 60*j* are provided at side end circumferences, and metal shaft 60*k* passing through both flanges 60*h* is provided. Both ends 40*c* of the photoreceptor 40 contact with only gap forming members 60*j*, accordingly, the surface of image forming area 40*b* of the photoreceptor 40 is faced to the charger surface with an interposed gap corresponding to the thickness of the gap forming members 60*j*. By such adjacent type of charger, there is provided no contact with the surface of the photoreceptor, therefore can evade a generation of unevenness by charging caused by bumpy contact of the charger, and can eliminate an abrasion of the photosensitive member (photoreceptor). In addition, the charger is placed close to the surface of the photoreceptor, therefore electric power supplied to the charger can be reduced, hence the generation of hazard gas such as ozone and nitrogen oxides and the like can be significantly decreased.

Figure 8:
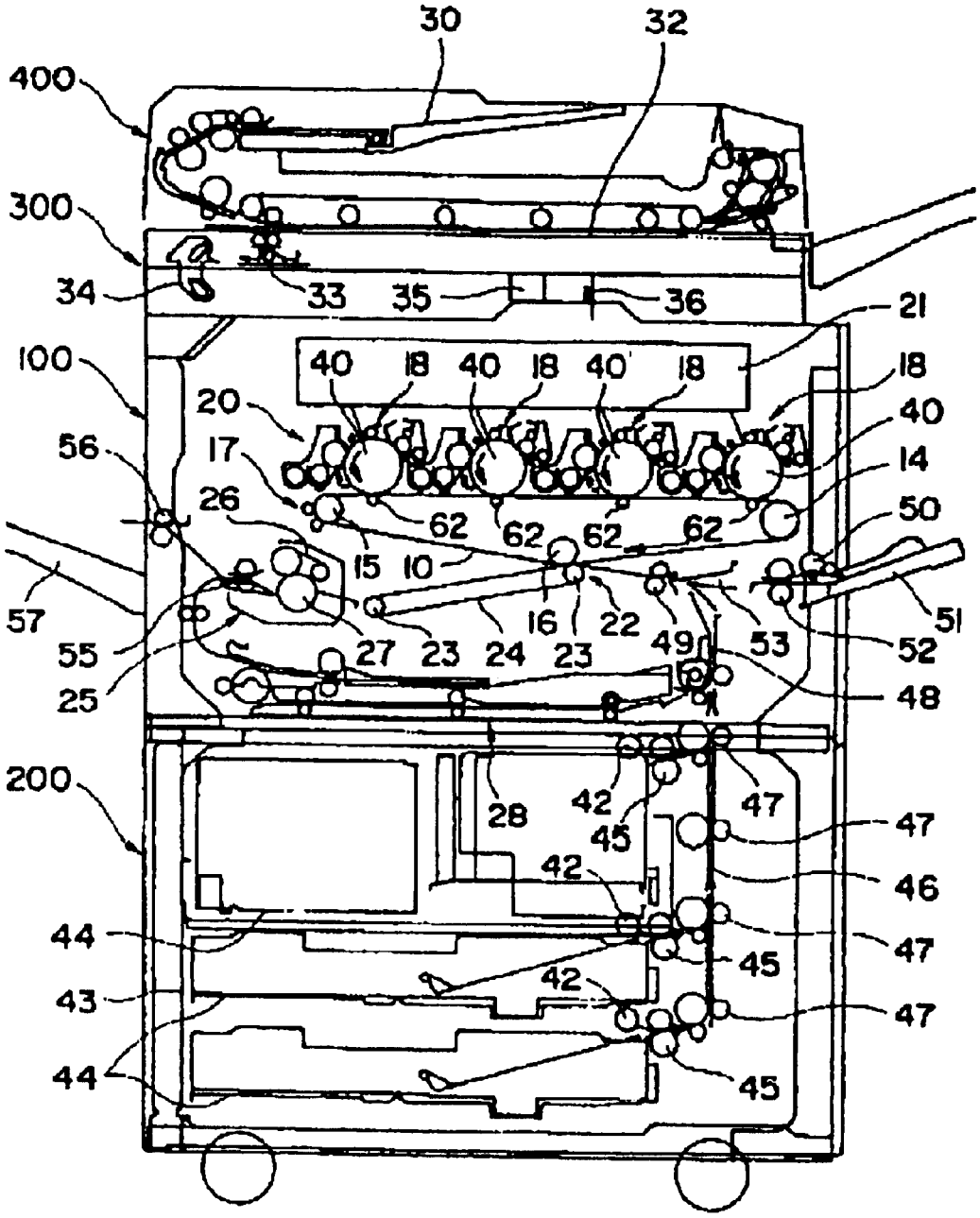
FIG. 8 is a schematic view illustrating the cross section of still another embodiment of the image forming apparatus called as tandem type of the present invention.

FIG. 8 is a schematic view illustrating the cross section of still another embodiment of the image forming apparatus called as tandem type of the present invention.

Referring to FIG. 8 of the drawings, an image forming apparatus embodying the present invention is shown and implemented as a color copier by way of example. As shown, the color copier is generally made up of a copier body 100, a sheet feed table 200 on which the copier body 100 is mounted, a scanner 300 mounted on the copier body 100, and an ADF (Automatic Document Feeder) 400 mounted on the scanner 300.

An intermediate image transfer belt 10 is positioned at the center of the copier body 100 and implemented as an endless belt (transfer belt 10 hereinafter). The transfer belt 10 is a laminate of a base layer, the base layer is formed of fluorocarbon resin, canvas or similar material that stretches little, and an elastic layer is formed on the base layer. This elastic layer is formed of, e.g., fluororubber or acrylonitrile-butadien copolymer rubber. The coating layer covering the elastic layer is formed of, e.g., fluorine-containing resin.

As shown in FIG. 8, the transfer belt 10 is passed over three rollers 14, 15 and 16 and turns in a clockwise direction. In the illustrative embodiment, a belt cleaner or cleaning device 17 is positioned at the left-hand side of the roller 15 for removing toner left on the transfer belt 10 after image transfer.

Four image forming means 18 are arranged side by side above and along the upper, substantially horizontal run of the transfer belt 10 between the rollers 14 and 15, constituting a tandem image forming device. The image forming means 18 are respectively assigned to black, cyan, magenta and yellow.

As shown in FIG. 8, an exposing unit 21 is positioned above the image farming device 20.

A secondary image transfer device 22 is arranged below the lower run of the transfer belt 10 and includes an endless, secondary image transfer belt (secondary transfer belt hereinafter) 24. The secondary transfer belt 24 is passed over two rollers 23 and pressed against the roller 16.

A fixing device 25 is positioned at one side of the secondary image transfer device 22 for fixing a toner image on a paper sheet or similar recording medium. The fixing device 25 includes an endless belt 26 and a press roller 27 pressed against the belt 26.

In the illustrative embodiment, the fixing device 25 is partly positioned below the lower run of the transfer belt 10 although the entire fixing device 25 may be so positioned.

The secondary image transfer device 22 additionally functions to convey the paper sheet to the fixing device 25 after image transfer. The secondary image transfer device 22 may, of course, be implemented as a charger that does not contact the transfer belt 10.

With a charger, however, it is difficult to implement the sheet conveying function.

A turning device 28 is positioned below the secondary image transfer device 22 and fixing device 25 in order to turn the paper sheet upside down in a duplex copy mode. The turning device 28 extends in parallel to the tandem image forming device 20.

In operation, the operator of the color copier sets a document on a document tray 30 included in the ADF 400 or opens the ADF 400, sets a document on a glass platen 32 included in the scanner 300, and then closes the ADF 400. Assume that the operator has set a document on the document tray 30 of the ADF 400.

Then, when the operator pushes a start switch, not shown, the ADF 400 conveys the document to the glass platen 32. Subsequently, a first and a second carriage 33 and 34 included in the scanner 300 are driven. While the first carriage 33 illuminates the document with a light source, the resulting reflection from the document is incident to a mirror included in the second carriage 34. The mirror reflects the incident imagewise light to an image sensor via a lens 35.

On the turn-on of the start switch, a drive motor, not shown, drives one of the rollers 14 through 16 to thereby cause the transfer belt 10 to turn. At the same time, each image forming means 18 rotates a respective image carrier 40, so that a black, cyan, magenta or yellow image is formed on the image carrier 40. The images respectively formed by the four image forming means 18 are sequentially transferred to the transfer belt 10 one above the other in accordance with the rotation of the belt 10, completing a full-color image on the belt 10. Let this image transfer be referred to as primary image transfer. In the illustrative embodiment, the image carriers are implemented as photoconductive drums by way of example.

Further, on the turn-on of the start switch, one of pickup rollers 42 disposed in the paper feed table 200 is driven to pay out a paper sheet from associated one of a plurality of sheet cassettes 44. A separator roller 45 separates paper sheets underlying the top paper sheet from the top paper sheet and conveys the top paper sheet to a sheet conveyance path 46. Rollers 47 sequentially arranged on the path 46 convey the paper sheet to a sheet conveyance path 48 arranged in the copier body 100, causing the paper sheet to abut against a registration roller pair 49.

On the other hand, assume that the operator stacks, e.g., paper sheets on a manual feed tray 51. Then, a pickup roller 50 is rotated to pay out the top paper sheet while a separator roller 52 separates paper sheets underlying the top paper sheet from the top paper sheet. This paper sheet also abuts against the registration roller pair 49.

In any case, the registration roller pair 49 starts conveying the paper sheet in synchronism with the rotation of the transfer belt 10, which carries the full-color image thereon.

The secondary image transfer device 22 conveys the paper sheet carrying the toner image to the fixing device 25. The fixing device 25 fixes the toner image on the paper sheet with heat and pressure. In a simplex copy mode, a path selector 55 steers the paper sheet toward an outlet roller pair 56, so that the paper sheet is driven out to a copy tray 57 via the roller pair 56. In a duplex copy mode, the path selector 55 steers the paper sheet into the turning device 28. The turning device 28 turns the paper sheet upside down and again delivers it to the secondary image transfer position. After a toner image as been formed on the reverse side of the same paper sheet, the outlet roller pair 54 drives the paper sheet to the copy tray 57.

After the image transfer, the belt cleaner 17 removes the toner left on the transfer belt 10 to thereby prepare it for the next image formation.

In general, the registration roller pair 49 is uscd with grounded in many cases, while for removal of paper powder from sheets, the roller pair 49 may be biased using electroconductive rubber roller such as, for example, rubber roller of 18 mm diameter covered by conductive NBR rubber. Conductive rubber has volume resistivity degree of about $10^9$ Ω girder.

More specifically, a negative bias voltage of about −800 V to +2000 V, for example, is applied to the reverse side of the paper sheet while a pressure about 50N/cm.sup.2, for example, is exerted on the same. As a result, toner forming the full-color image is attracted toward the paper sheet away from the transfer belt 10 and transferred to the paper sheet. In intermediate transfer system, paper powder is hardly migrated to the photoreceptor, therefore, there is few necessity to consider against such situation, and grounding is allowable in almost cases. And as applied potential, instead of DC bias potential, AC potential having DC offset component may be applied for more evenness charging of the photoreceptor surface.

The secondary image transfer device 22 transfers the full-color image from the transfer belt 10 to the paper sheet. This image transfer will be referred to as secondary image transfer.

Paper surface having been passed through the registration roller pair 49 imposed a bias potential is charged somewhat negative. Accordingly, there is a necessity to change the transfer condition pursuant to the changed situation, in comparison with the case of the registration roller pair 49 imposed no bias potential.

Figure 9:
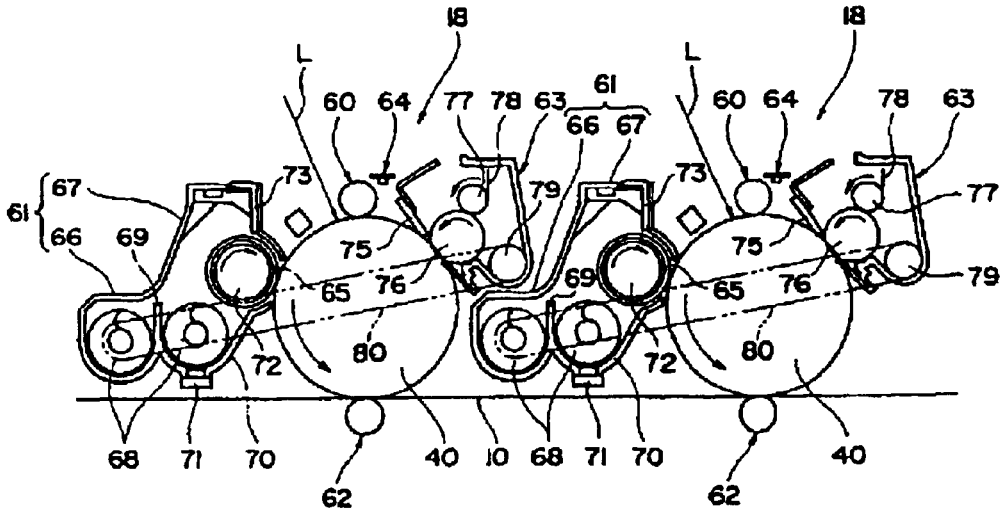
FIG. 9 is an enlarged schematic view illustrating the cross section of the vicinity of photosensitive member in the tandem type of image forming apparatus of FIG. 8.

FIG. 9 shows part of the tandem image forming device 20 in detail. As shown, each image forming means 18 includes a charger 60, a developing device 61, a primary image transfer device 62, a drum cleaner or cleaning device 63 and a discharger 64 arranged around the previously mentioned drum photoreceptor 40.

Figure 10:
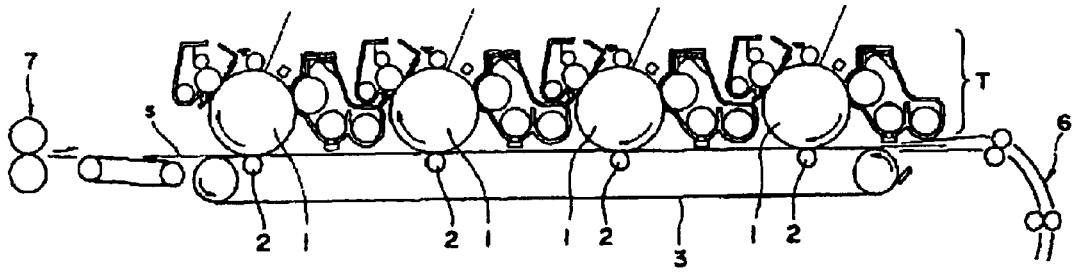
FIG. 10 is a schematic view illustrating the cross section of an embodiment of a transfer mean (direct transfer )used for the tandem type of image forming apparatus of FIG. 8.
Figure 11:
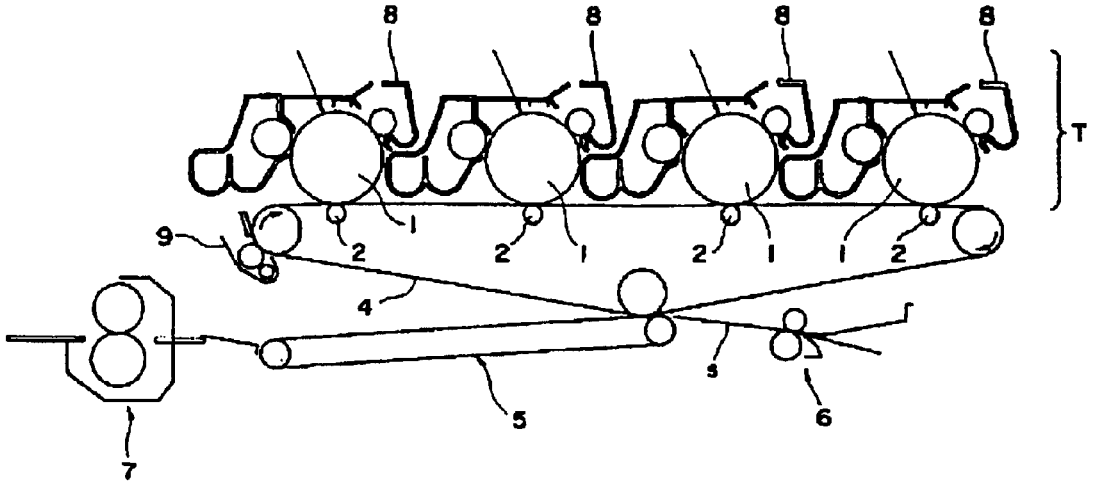
FIG. 11 is a schematic view illustrating the cross section of an embodiment of another transfer mean using an intermediate transfer medium (indirect transfer ) used for the tandem type of image forming apparatus of FIG. 8.

There are a immediate transfer system as shown in FIG. 10 and an mediate transfer system as shown in FIG. 11 in the tandem image forming system using tandem image forming device. The immediate transfer system transfers each image formed on respective photoreceptors to the sheet(s) transported by sheet transporting belt 3 with using transfer apparatus 4 one by one. The mediate transfer system temporary transfers each image formed on respective photoreceptors to the intermediate transfer medium 4 one after another with using primal transfer apparatus 2, then the image formed on the intermediate transfer medium 4 transfers with using secondary transfer apparatus 5 at once. The later the intermediate transfer system is a system using transfer transport belt, instead of the transfer transport belt, transfer roller can be used.

Comparing an immediate transfer system with a mediate transfer system, the former has a shortcoming that the paper feeder 5 has to be provided at upstream side, and the fixer 7 has to be provided at downstream side, thus the apparatus is enlarged in direction of paper transportation. On the other hand, the latter can install the secondary transfer mean comparative freely, hence is capable of down sizing the apparatus.

In addition, the former has to bring the fixer 7 close to the tandem type of image forming unit(T), for avoiding the expansion of the apparatus scale, therefore can not install the fixer 7 with satisfactory space margin so as to make the sheet bendable, and causes shortcomings that the fixer 7 is likely to affect to image forming action in upstream side, by a shock occurred at inserting the sheet head into the fixer 7, or by a velocity differential between transporting speed of the sheet in passing through the fixer 7 and transporting speed of the sheet in passing through the transfer belt.

On the other hand, the latter can install the fixer with satisfactory space margin so as to make the sheet bendable, therefore it is possible to design the fixer 7 does not affect to image forming action.

Based upon such circumstances, in recent years, an attention has been paid to particularly the mediate transfer method using intermediate transfer belt medium, among tandem type of electrophptographic image forming apparatus.

Intermediate transfer belt medium has been made by using fluoride resin, polycarbonate resin, polyimide, resin and the like resins, while in recent years, the use of elastic belt made of elastic material in whole layers or partial layers thereof has been increasing There are problems with color image transfer system using conventional resin belt as described hereinafter. Namely, In general, the color images are composed from four toners, and each toner being colored by respective own coloring agent. And one to four toner layers are formed for one color image. Pressures are given to the each toner layer in the courses of the first transfer operation to transfer the toner from the developed photosensitive member to the intermediate transfer belt, and the second transfer operation to transfer the toner on the intermediate transfer belt to the image recording sheet. Thus the aggregation force between toner particles is enhanced. The enhanced aggregation force between toner particles is apt to cause an interim void in letter image and a void induced by edge effect in solid image. In particular, the resin belts having been used hitherto possess a high hardness, accordingly does not transforms pursuant to the existing toner layers, therefore is apt to compress the toner layer hence is apt to occur the inside dropout in letter image.

And in recent years, a requirement for forming the full-color image on various papers for instances Japanese paper or artificially embossed paper has been growing larger. However the paper having an inferior evenness surface is likely to occur the air-gaps between its surface and toner layer, hence is apt to occur an interim void caused with transferring in letter image. If increasing the transferring pressure at second transfer section for the purpose of increasing the fitness contact, it results an enhanced aggregation of toner layer, hence causes aforementioned interim void in letter image.

The elastic belt can dissolve shortcomings caused by use of resin belt, as follow.

In the image forming apparatus of the present invention, the intermediate transfer medium is an elastic belt, the elastic belt has lower hardness in comparison with the resin belt, thus is transformed pursuant to toner layer and inferior evenness paper. Namely aforementioned elastic belt is tamed to local unevenness to transform, therefore can obtain a fitness contact without elevating the pressure for transferring the toner layer. By this feature, a transferred image having no interim void of letter image, and an excellent uniformity even if for a paper of unevenness surface can be obtain.

Aforementioned elastic belt may conclude one or more materials selected from a group consisting of, but not restricted to, polycarbonate, fluoride resin such as ETFE, PVDF, polystylene, chloropolystylene, poly-α-methylstylene, stylene-butadiene copolymer, stylene-vinylchliride copolymer, stylene-vinylacetic acid copolymer, stylene-maleic acid copolymer, stylene-acrylate ester copolymer such as stylene-methyl acrylate copolymer, stylene-ethyl acrylate copolymer, stylene-butyl acrylate copolymer, stylene-octyl acrylate copolymer, stylene-phenyl acrylate copolymer and so forth, stylene-methacrylate ester copolymer such as stylene-methyl methacrylate copolymer, stylene-ethyl methacrylate copolymer, stylene-phenyl methacrylate copolymer and so forth, stylene type of resin containing single polymer or copolymer from stylene or satylenederivative such as stylene-α-chloro-methylacrylate copolymer, stylene-acrylonitrile-acrylate ester copolymer copolymer, methyl methacrylate resin, ethyl methacrylate resin, butyl methacrylate resin, modified acrylic resin such as silicone-modified acrylic resin, vinylchloride resin-modified acrylic resin, acrylic-urethane resin and so forth, vinylchloride resin, stylene-vinylacetic acid resin, vinylchloride-vinylacetic acid resin, rosin-modified maleic resin, phenol resin, epoxy resin, polyester resin, polyester-polyurethane resin, polyethylene, polypropylene, polybutadiene, poly vinylidene chloride, ionomer resin, polyurcthanc resin, silicone resin, ketone resin, ethylene-ethylacrylate copolymer, xylene resin, polyvinyl butyral resin, polyamido resin, modified polyphenyleneoxide resin. Above described material is used alone or in combination.

Aforementioned elastic belt is made by using one or more elastic rubber materials or elastomer materials selected from a group consisting of, but not restricted to, butyl gum, fluoride gum, acrylic rubber, EPDM, NBR, acrylonitril-butadiene stylene rubber, natural gum, isoprene gum, stylene-butadiene rubber, isoprene rubber, stylene-butadiene rubber, butadiene rubber, stylene-butadiene rubber, butadiene rubber, ethylene-propylene terpolymer, chloroprene gum, chloro-sulfonated polyethylene, chlorinated polyethylene, urethane rubber, syndiotactic-1,2-polybutadine, epichlorohydrin type of rubber,silicone type of rubber, fluoride rubber, polysulfide rubber, polynorbornene rubber, hydrogenated nitril gum, thermoplastic elastomer such as stylene type of, polyolefin type of, poly vinylchloride type of, polyurethane type of, polyamide type of, polyurea type of, polyester type of, fluoride type of elastomers Above described elastic rubber material or elastomer material is used alone or in combination.

Elastic belt in the present invention may include conductant agent to control resistance.

There is no restriction for the conductant agent to control resistance, and specific examples are, but not limited to, carbon black, graphite, metal powder such as aluminum, nickel, conductive metal oxide such as tin oxide, titanium oxide, antimony oxide, indium oxide, titanate calcium, antimony oxide-tin oxide complex(ATO), indium oxide-tin oxide complex(ITO). The conductive metal oxide may be covered by insulator oxide such as barium sulphate, magnesium silicate, calcium carbonate.

There is no restriction for the surface material used the elastic belt in the present invention, as far as it can reduce adhesion of toner to the belt surface, and can increase the ability of the toner to secondary transfer from the belt surface. Specific examples of the surface material are, but not limited to, a material causing a low surface energy state of the belt, which is used with one or more materials such as polyurethane, polyester, epoxy resin and the like. To be more tangible, for examples, powder of fluoride resin, fluoride compounds, carbon fluoride, titanium dioxide, silicone carbide and the like can be used by dispersing one or more kind of powders or powders having different sizes. In addition, a material being reduced in the surface energy state by making an abundant fluorine emerged to the surface by heat treatment, for example fluoride rubber material, also favorably used.

There is no restriction for preparation method of the elastic belt.

For examples, centrifugal forming method in which belt is formed by pouring a material into a cylindrical die which being rotated, spray coating method by which thin surface layer is obtainable, dipping method in which source belt is dipped into a bath of treating liquid then the treated belt is drawn up from the bath, mold casting method in which material to be formed is poured into a space provided between inner die and outer die, vulcanization method in which compound of raw material to be formed is winded on peripheral surface of die and valcanizing and grinding up it, can be instanced, but no restricted by them. The methods may be used in combination.

As prevention method of stretch in the belt, for examples, there are a method in which fiber wick material is employed as a wick layer and thereon rubber layers are provided, and another method in which a material for preventing the stretch of the belt is incorporated in the wick material and other method. However the present invention does not consider with production method of the belt.

Wick material used to prevent of the stretch in the belt is one or more materials selected from a group consisting of, for examples, but not restricted to, cotton fibers, synthetic fibers such as nylon fibers, acrylic fibers, polyolefin fibers, polyvinylalcohol fibers, polyvinylchloride fibers, polyvinylidenechloride fibers, polyurethane fibers, polyvinylacetal fibers, polyfluoroethylene fibers, phenol resin fibers, inorganic fibers such as carbon fibers, glass fibers, boron fibers, metal fibers such as steel fibers, copper fibers. Above described wick material is used alone or in combination, for example by mixed spinning, Strings or yarns can be any swisted filaments, for example single swisted yarn, dual swisted yarn, multiple swisted yarn, blend yarn, or textile mixture woven using the strings or yarns can be used. Any fabrication mode, texture, form can be used. And of course, the strings, yarns, textiles obtained therefrom can be treated by conductant agent, before or after spinning or weaving.

There is no restriction for the method of providing the wick layer. For examples, a method in which textile woven in cylindrical shape is put over on a die of cylindrical shape, and thereon the coating layer is provided, another method in which textile woven in cylindrical shape is dipped into a bath of the liquified rubber to provide the rubber layer to one or both sides thereof, or other method in which string or yarn is wind up in spiral mode onto the peripheral surface of a cylindrical shape of die, and thereon the coating layer is provided, can be referred.

With regard to the thickness of the elastic layer, even though it depend upon the hardness of the elastic layer, an excess in the thickness causes expansions and contractions at the outermost layer of the elastic layer, thus apt to occur the cracks thereon. In addition, great deal in the expansions and contractions affects to the size stability of the image obtained, hence unfavorable. The thickness of the elastic layer is favorably about 1 mm or less.

Adequate range of the hardness (HS) of the elastic layer is in 10°≦to ≦65°. Optimum thickness of the elastic layer depends upon the hardness of the elastic layer, therefore the adjustment of the hardness is desired. The hardness less than 10° results a serious difficulty to form the elastic layer with an excellent accuracy This is brought by the nature that the elastic layer apt to receive expansions and contractions by forming procedure thereof. And if wanted to be soften, an addition of oily component to the base material is a general processing, however this processing has a drawback that the oily component is oozed out by continuos operation under the pressure. It becomes clear by our studies that if aforementioned oily component adhere, then makes traversal strap blurring. In general, a surface layer has been provided to improve the repellency of the photosensitive member surface, but the entire prevention of the ooze out of the oily component must depend on the employment of a surface layer having high quality such as excellent durability for chemicals and the like, hence the qualification and the selection of characteristics of the material to be used becomes difficult.

On the other hand, if the hardness of the intermediate transfer medium exceeds 65°, the increase in the hardness causes a higher dimensional precision of the formed one, and moreover, the decreased or eliminated addition of the oily component become possible. This means that the adhesion of the oily component to the photosensitive member can be decrease, however the improvements of the transfer nature such as a decrease of the interim void of letter image and so forth become impossible. And in case of a large excess hardness, thus the intermediate transfer must hardly pass over between tension rollers.

FIG. 9 shows part of the tandem image forming device 20 in detail. As shown, each image forming means 18 includes a charger 60 which being made in roller shape and is contacted with the photoreceptor 40 to make it charged, a developing device 61, a primary image transferring device 62, a drum cleaner or cleaning device 63 and a discharger 64 arranged around the previously mentioned drum 40. Of course the charger can be substituted by conventional non contact type of charger such as sorototron charger. The drum 40 may be replaced with an endless, photoconductive belt, if desired. Further, each image forming means 18 may be entirely or partly constructed into a single process cartridge that is removable from the copier body 100 for easy maintenance. In the illustrative embodiment, the charger 60 is implemented as a charge roller capable of charging the image carrier 40 in contact therewith.

Figure 12:
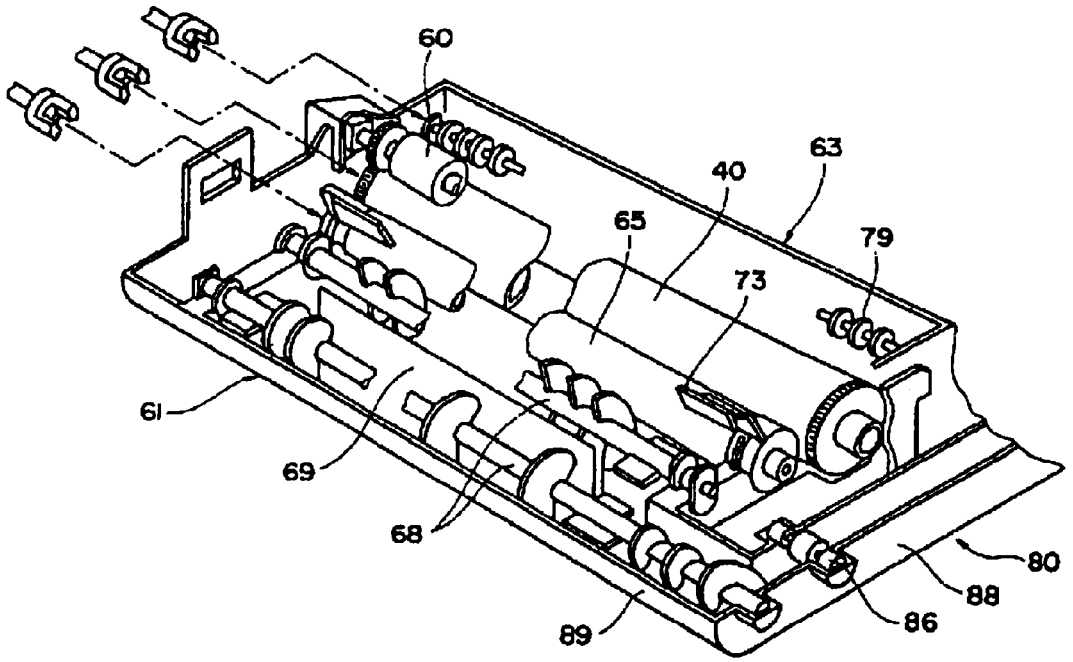
FIG. 12 is a schematic view illustrating the cross section of an embodiment of a developing apparatus used for the tandem type of image forming apparatus of FIG. 8.

In the illustrative embodiment, the developing device 61 stores a mixture of magnetic carrier and non-magnetic toner, i.e., a two-ingredient type developer which of course can be substituted by a single-ingredient type developer, The developing device 61 is generally made up of an agitating section 66 and a developing section 67. The agitating section 66 conveys the developer while agitating the developer and deposits it on a sleeve 65. The developing section 67 transfers the developer from the sleeve 65 to the drum 10. The agitating section 66 is positioned at a lower level than the developing section 67. The agitating section 66 includes two parallel screws 68 that are isolated from each other by a partition 69 except for opposite ends thereof, as shown in FIG. 12. A toner content sensor 71 is mounted can a case 70 for sensing the toner content of the developer.

The sleeve 65 disposed in the developing section 67 faces the drum 40 via an opening formed in the case 70. A magnet roller 72 is held stationary within the sleeve 65. A doctor blade or metering member 73 adjoins the sleeve 65. In this embodiment, the distance between the doctor blade 73 and the sleeve 65 is 500 $\mu$m.

The two screws 68 circulate the developer in the case 70 while agitating the developer and feed it toward the sleeve 65. The magnet roller 72 magnetically scoops up the developer onto the sleeve 65. The developer deposits on the sleeve 65 and forms a magnet brush. While the sleeve 65 in rotation conveys the magnet brush, the doctor blade 73 regulates the height of the magnet brush. The magnet brush removed by the doctor blade 73 is returned to the agitating section 66.

The developer, i.e., toner transferred from the sleeve 65 to the drum 40 develops a latent image farmed on the drum 40 to thereby form a corresponding toner image. After the development, the developer left on the sleeve 65 leaves the sleeve 65 at a position where the magnet roller 72 does not exert any magnetic force, and also returns to the agitating section 66. When the toner content of the developer in the agitating section 66 becomes short due to repeated development, as determined by the toner content sensor 71, fresh toner is replenished to the agitating section 66.

As for the purpose of just reference, In this embodiment, liner speed of the photoreceptor 40 was set to 200 mm/sec, and liner speed of the sleeve 65 was set to 240 mm/sec. With the photoreceptor having 50 mm diameter and the sleeve 65 having a diameter of 18 mm, developing process was conducted. The charge amount of toner on the sleeve 65 is favorably in the range negative −10 $\mu$C/g to negative −30 $\mu$C/g. The development gap(GP) between the photoreceptor 40 and the sleeve 65 was set in a distance from 0.8 mm to 0.4 mm similarly as that of prior art, but a smaller distance can cause higher efficiency in development. The thickness was 30 $\mu$m, diameter of the beam spot in lighting system was 50 $\mu$m×60 $\mu$m, light emission strength was 0.47 mW, And the electric charge potential ($V_0$) before light exposure was negative 600 V, the charge potential ($V_L$) after light exposure was negative 100 V, development vias potential was negative 350 V, namely 250 V of development potential was imposed.

The primary image transfer device 62 is implemented as a roller pressed against the drum 40 with the intermediary of the transfer belt 10. The roller may be replaced with a charger that does not contact the transfer belt 20, if desired.

The drum cleaner 63 includes a cleaning blade 75 formed of, e.g., polyurethane rubber and contacting the drum 40 at its edge.

A conductive fur brush 76 is held in contact with the drum 40 and rotatable in a direction indicated by an arrow in FIG. 4. metallic roller 77 is rotatable in a direction indicated by an arrow in FIG. 4 for applying a bias to the fur brush 76. A scraper 76 has its edge held in contact with the roller 77. A screw 79 collects the toner removed from the roller 77 by the scraper 78.

More specifically, the fur brush 76 rotating in a direction counter to the drum 40 removes the residual toner from the drum 40. The roller 77 rotates in a direction counter to the fur brush 76 while applying the bias to the fur brush 76, thereby removing the toner from the fur brush 76. Further, the scraper 78 removes the toner from the roller 77. The screw 79 conveys the toner removed by the scraper 78 to a waste toner bottle, not shown, or returns it to the developing device 61 for reuse, as the case may be.

The discharger 64, which is implemented by a lamp by way of example, discharges the surface of the drum 40 with light so as to initialize the surface potential of the drum 40.

In operation, while the drum 40 is rotated, the charger 60 uniformly charges the surface of the drum 40. The exposing device 21 scans the charged surface of the drum 40 with light L issuing from, e.g., a laser or LEDs (Light Emitting Diodes) in accordance with the output of the scanner 300. As a result, a latent image is electrostatically formed on the drum 40.

The developing device 61 deposits toner on the latent image to thereby form a corresponding toner image on the drum 40. The primary image transferring device 62 transfers the toner image from the drum 40 to the transfer belt 10. The drum cleaner 63 removes the toner left on the drum 40 after the image transfer. Subsequently, the discharger 64 discharges the surface of the drum photoreceptor 40 to thereby prepare it for the next image formation.

Figure 13:
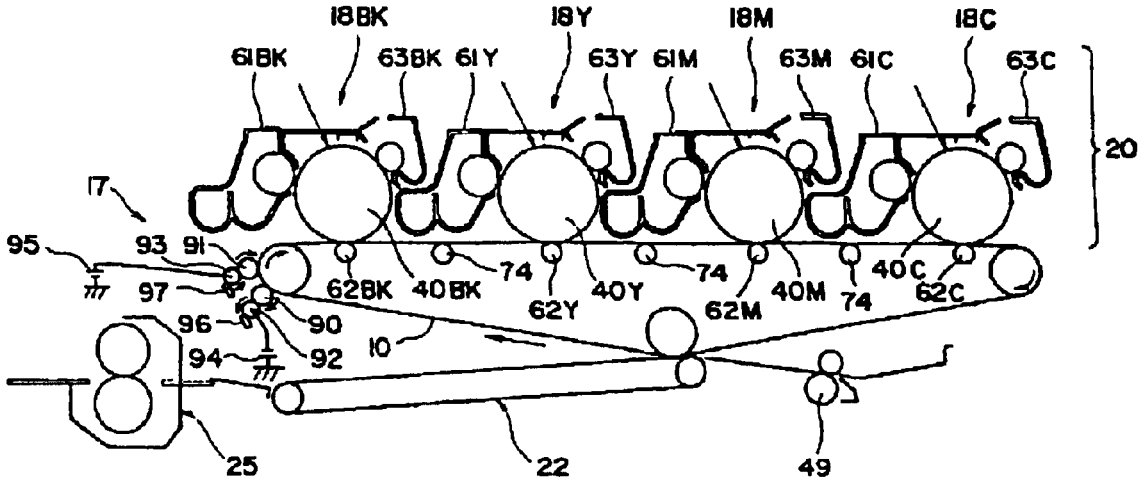
FIG. 13 is an enlarged schematic view illustrating the cross section of the principal part of the tandem type of image forming apparatus of FIG. 8.

FIG. 13 is an enlarged view showing a featuring section of the apparatus of FIG. 8. In the drawing, each image forming means 18, each photoreceptors 40 of the each image forming means 18, each photoreceptor cleaning means 63, each primary transfer means facing to the each photoreceptors 40, of the tandem type of image forming apparatus, are marked signs BK for black, Y for yellow, M for magenta, C for cyan colors.

Sign 74 in FIG. 13, which is not shown in FIGS. 8 and 9, an electroconductive roller which is provided in the inside periphery of intermediate transfer medium 10, in contact with the transfer medium 10. By this conductive roller 74, a biased electricity imposed by primary transfer apparatus 62 is interrupted to flow, through base layer having medium electric resistance, in each image forming apparatus.

Figure 14:
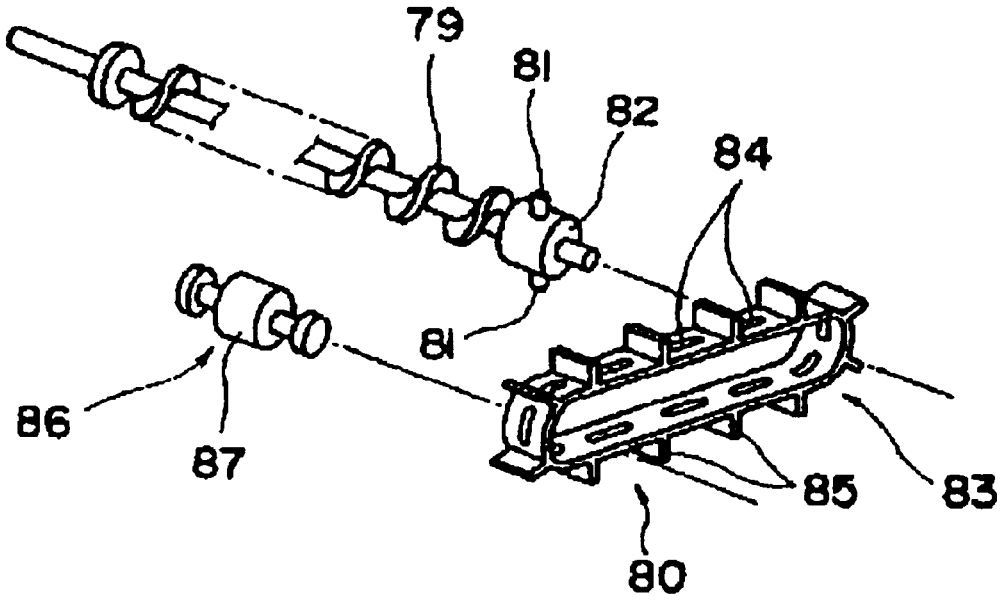
FIG. 14 is a schematic view illustrating the cross section of a toner recycle apparatus used in the tandem type of image forming apparatus of FIG. 8.

FIGS. 14 and 12 show an embodiment of a toner recycle apparatus 80 which can be used in the image forming apparatus of the present invention. As shown in drawings, A roller part having in its one end a pin 81 is provided in a recovery screw 79 of the photoreceptor cleaning apparatus 63. And, a side of a belt shape of recovered toner-transporting member 83 of the toner recycle apparatus 80, and the pin 81 is inserted to an along opening 84 of the recovered toner-transporting member 83. Blades 85 are provided on the outer periphery of the recovered toner-transporting member 83 by a constant distances, and other end of the recovered toner-transporting member 83 is suspended to a roller part 87 of the rotation axis 86.

The recovered toner-transporting member 83 is, together with the rotation axis 86, equipped in a passage case 88. The passage case 88 is being composed together with a cartridge case 89, and to a side end of a development apparatus 61, one of aforementioned two screws 68, a side end of a development apparatus 61 is induced.

And, recovery screw 79 is rotatated with a driving power transmitted from the outside, recovered toner-transport member 83 is rotatated to be transferred, toner recovered by photoreceptor cleaner 63 is transported to the developing apparatus 61 through the passage case 88, then introduced into the inside of the developing apparatus 61 by rotating 68. Thereafter, as described above, the toner, together with another toner which having been in the developing apparatus 61, is abdicated by the two screw 68, and transferred for recycling to the development sleeve 65, and cut by doctor blade 73 and transferred to the photoreceptor 40, to develop the latent image positioned on the photoreceptor 40.

The development sleeve 65 has a non magnetic configuration of rotatable sleeve shape, and hold a plurality of magnets 72 in its inside. The magnets 72 are fixed in the sleeve 62, therefore are made to influence their magnetic force to the developer passing through the predetermined passage. In the shown embodiment, diameter of the sleeve 65 is 18 mm, and the processing for changing the surface to Rz value ranging 10 to 30 $\mu$m, and for giving scratches is carried out by sand-blasting blushing, meshing or filing and so forth.

The magnets 72 have five of magnetic poles of N1, S1, N2, S2, S3 which are positioned from doctor blade 73 to rotation directing of the development sleeve 65. The developer is formed to magnet blush, which is held on the development sleeve 65. The development sleeve 65, with facing to the photosensitive member 40, is positioned in S1 side region of magnets 72 forming a magnet blush of the developer.

As shown in FIG. 13, there are provided two fur blush 90 and 91 to the cleaning device 17. The used fur blush 90 and 91 is 20 mm diameter, acrylic carbon, 6.25 D/F, $10^5$/square inch, E+7 Ω. The fur blush 90 and 91 is rotated in counter direction of the rotation of the intermediate transfer medium 10, and to each blush 90 and 91, opposite polarity of potentials are applied.

Metallic rollers 92 and 93 are provided to the fur blush 90 and 91 respectively, so as to rotate in ordinal direction and reversal direction, with contact to the fur blush 90 and 91, and in the embodiment, negative potential is imposed from the source 94 to the metallic roller 92 positioned in the front in terms of the upwardly rotating intermediate transfer medium 10, and positive potential is imposed from the source 95 to the metallic roller 93 positioned in the rear of the intermediate transfer medium 10. And the heads of the blades 96 and 97 are contacted on respective metallic roller 92 and 93.

And, pursuant to the rotating of intermediate transfer medium 10 to the arrow mark direction, at the first time, the surface of intermediate transfer medium 10 is cleaned using fur blush 90 positioned in upstream direction in terms of rotating direction of intermediate transfer medium 10. If negative 700V of potential is applied to the metallic roller 92, fur blush 90 is in negative 400 V, thus toner, which is being charged in positive and placed to on the intermediate transfer medium 10, is transferred to the fur blush 90.

Toner removed from the intermediate transfer medium 10 is again transferred to the metallic roller 92 from the fur blush 90, then scratch out by blade 96.

Now, toner on the intermediate transfer medium 10 is removed by fur blush 90, but a lot of toner are still remaining on the intermediate transfer medium 10, these remaining toners are negatively charged by a vias negative potential imposed on fur blush 90. It is thought that such phenomenon is caused by negative potential imposed to the fur blush 90, or charge injection or discharging.

However, at next moment, by cleaning with positive potential using another fur blush 91 positioned in in downstream direction in terms of rotating direction of intermediate transfer medium 10, the remaining toner can removed. Then the removed toner is scratched out by blade 97.

The toners scratched out by blades 96 and 97 are recovered to a container which is not shown in the drawing.

Almost all toner on the intermediate transfer medium 10 are cleaned by fur blush 91, However, still very few toner may remain on the intermediate transfer medium 10. The toner being remained on the intermediate transfer medium 10 is, as aforementioned, charged in positive by bias potential imposed fur blush 91. The toner being charged in positive, transferred to the photoreceptor side, by electric field applied with primary transfer action. The most significant transfer of the toner is conducted by primary transfer.

In this embodiment, ordering for forming colors is not restricted, and it depend upon the characteristics of the apparatus or purpose of processing.

EXAMPLES

Having generally described this invention, further understanding can be obtained by reference to following specific examples which are provided herein for the purpose of illustration only and are not intended to be limiting. In the descriptions in the following examples, the numbers represent weight ratios unless otherwise specified.

Example 1

Alkid resin (Bekkozol 1307-60-EL made by Dainippon Ink & Chemicals Inc.) 15 parts, melamine resin (Super Bekkamin G-821-60, 60% non volatile component made by Dainippon Ink & Chemicals Inc.) 10 parts were dissolved in 150 parts of methylethylketone, to this solution, 90 parts of titanium oxide powder (Tipaque CR-EL made by Ishihara Sangyo Kaisha, Ltd.) were added, then the liquid was dispersed for 12 hours using a ball mill, to prepare a coating liquid for under coat layer.

The obtained coating liquid for under coat layer was coated onto an Al drum base having 30 mm diameter and 340 mm length, then it was dried at 130° C. for 20 minutes, to form an under coat layer having 3.5 μm thickness on the A1 drum base.

Then, 4 parts of polyvinylbutyral resin (S-lec BL-S made by Sekisui Chemical Co, Ltd.) were dissolved in 150 parts of cyclohexanone, to this solution, 10 parts of a trisazo pigment having a chemical formula (1) shown bellow, was added, then the mixture was dispersed for 48 hours using a ball mill, thereafter 210 parts of cyclohexanone were added and dispersed for three hours. The liquid was took out to a vessel and diluted by cyclohexanonc so as to attain 1.5% of solid component content. Thus obtained coating liquid for preparing charge generating layer was coated on above described under coat layer, then it was dried at 130° C. for 20 minutes, to form a charge generating layer having 0.2 μm thickness on the under coat layer.

(1)

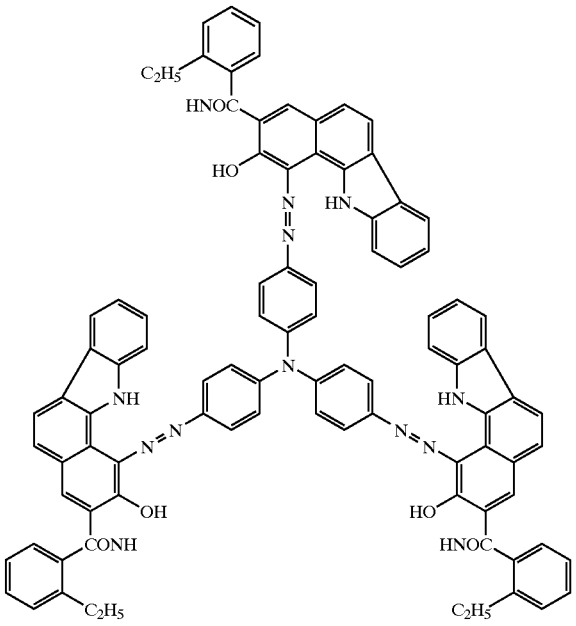

On the other hand, to 83 parts of tetrahydrofran, 10 parts of polycarbonate resin of bisphenol Z type, 0.002 part of silicone oil (KF-50 made by Shin-Etsu Chemical) were dissolved, and to the solution, 8 parts of a charge transfer material having a chemical formula (2) shown bellow, was added to prepare a coating liquid for the charge transfer layer, then it was coated on the charge generating layer, and dried it, to form a charge transfer layer having 20 μm thickness on the charge generating layer.

(2)

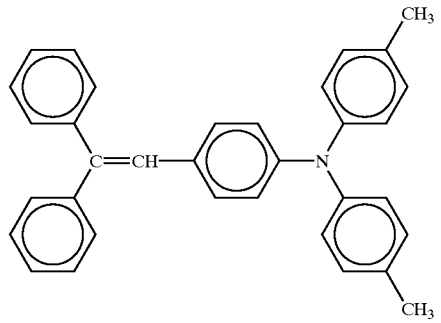

Further, to a mixed solvent consisting of 200 parts of cyclohexanone and 700 parts of tetrahydrofran, 15 parts of acrylic resins (Hitaloid 3001 50% non volatile component made by Hitachi Chemical Co. Ltd.), 5 parts of melamine resin (Cymel 303 made by MITSUI CYTEC LTD.), 0.05 parts of aromatic sulfonic acid (Catalist 4040 40% non volatile component made by MITSUI CYTEC LTD.) were dissolved, then 9 parts of silica (KMPX-100, made by Shin-etsu Chemical Ltd.) was added, the mixture was dispersed for 48 hours using a ball mill, to form a coating liquid for a protection layer.

The formed coating liquid was coated on the charge transfer layer by spray coating method, and dried at 130° C. for 20 minutes, to form a protection layer having 2 μm thickness on the charge transfer layer.

Thus an electrophotographic photoseisitivc member of Example 1 was prepared.

Example 2

Similar manner as that of Example 1 was executed and photosensitive member of Example 2 was prepared, with exception of the point that 8.6 parts of charge transfer material of above described chemical formula (2), 20 parts of melamine resin (Cymel 303 made by MITSUI CYTEC LTD.), 0.05 part of aromatic sulfonic acid(Catalist 4040 40% non volatile component made by MITSUI CYTEC LTD.) were dissolved into 200 parts of cyclohexanone and 700 parts of tetrahydrofran, then 9 parts of silica (KMPX-100 made by Shin-etsu Chemical Ltd.) was added, and the liquid was treated by a ball mill for 48 hours, to form a coating layer for the protection layer was prepared.

Example 3

Similar manner as that of Example 1 was conducted and photosensitive member of Example 3 was prepared, with exception of the point that 8.6 parts of charge transfer material of above described chemical formula (2), 15 parts of acrylic resin (Hitaloid 3001 50% non volatile component made by Hitachi Chemical Co. Ltd.), 5 parts of melamine resin (Cymel 303 made by MITSUI CYTEC LTD.), 0.05 part of aromatic sulfonic acid(Catalist 4040 40% non volatile component made by MITSUI CYTEC LTD.) were dissolved into 200 parts of cyclohexanone and 700 parts of tetrahydrofran, then 9 parts of silica (KMPX-100 made by Shin-etsu Chemical Ltd.) was added, and the liquid was treated by a ball mill for 48 hours, to form a coating layer for the protection layer was prepared.

Example 4

Similar manner as that of Example 3 was executed and photosensitive member of Example 4 was prepared, with exception of the point that 5 parts of the melamine resin was substituted by 6.5 parts of guanamine resin (My coat 106, 77% non volatile component made by MITSUI CYTEC LTD.).

Example 5

Similar manner as that of Example 3 was executed and photosensitive member of Example 5 was prepared, with exception of the point that 15 parts of the acrylic resin was substituted by 12.5 parts of another acrylic resin (Hitaloid 2468 60% non volatile component made by Hitachi Chemical CO. Ltd.).

Example 6

Similar manner as that of Example 3 was executed and photosensitive member of Example 6 was prepared, with exception of the point that 15 parts of the acrylic resin was substituted by 13.6 parts of another acrylic resin (Hitaloid 3509 55% non volatile component made by Hitachi Chemical CO. Ltd.).

Example 7

Similar manner as that of Example 4 was executed and photosensitive member of Example 7 was prepared, with exception of the point that 6.5 parts of the guanamine resin (My coat 106 77% non volatile component made by MITSUI CYTEC LTD.) was substituted by 8.3 parts of melamine resin (Super Bekkamin G-821-60, 60% non volatile component made by Dainippon Ink & Chemicals Inc.)

Example 8

Similar manner as that of Example 4 was executed and photosensitive member of Example 8 was prepared, with exception of the point that parts of 6.5 parts of the guanamine resin (My coat 106 77% non volatile component made by MITSUI CYTEC LTD.) was substituted by 5 parts of another guanamine resin (Cymel 1123 made by MITSUI CYTEC LTD.)

Example 9

Similar manner as that of Example 4 was executed and photosensitive member of Example 9 was prepared, with exception of the point that parts of 6.5 parts of the guanamine resin (My coat 106 77% non volatile component made by MITSUI CYTEC LTD.) was substituted by 7.1 parts of another guanamine resin (My coat 1128, 70% non volatile component made by MITSUI CYTEC LTD.)

Example 10

Similar manner as that of Example 4 was executed and photosensitive member of Example 10 was prepared, with exception of the point that the amounts of the acrylic resin,and the guanamine resin were changed to respectively 9.9 parts, and 9.7 parts.

Example 11

Similar manner as that of Example 4 was executed and photosensitive member of Example 11 was prepared, with exception of the point that the amounts of the acrylic resin,and the guanamine resin were changed to respectively 22.3 parts, and 1.6 parts.

Example 12

Similar manner as that of Example 4 was executed and photosensitive member of Example 12 was prepared, with exception of the point that the amounts of the charge transfer material having chemical formula (2) was changed to 4.1 parts.

Example 13

Similar manner as that of Example 4 was executed and photosensitive member of Example 13 was prepared, with exception of the point that the amounts of the charge transfer material having chemical formula (11) was changed to 36.86 parts.

Example 14

Similar manner as that of Example 4 was executed and photosensitive member of Example 14 was prepared, with exception of the point that the amounts of the aromatic sulfonic acid was changed to one(1) part.

Example 15

Similar manner as that of Example 4 was executed and photosensitive member of Example 15 was prepared, with exception of the point that the amounts of the silica was changed to 1.2 parts.

Example 16

Similar manner as that of Example 4 was executed and photosensitive member of Example 16 was prepared, with exception of the point that the amounts of the silica was changed to 24 parts.

Example 17

Similar manner as that of Example 3 was executed and photosensitive member of Example 17 was prepared, with exception of the point that the silica was substituted by almina (AA03 made by Sumitomo Chemical Co, Ltd.).

Example 18

Similar manner as that of Example 4 was executed and photosensitive member of Example 18 was prepared, with exception of the point that the silica was substituted by almina (AA03 made by Sumitomo Chemical Co, Ltd.).

Example 19

Similar manner as that of Example 3 was executed and photosensitive member of Example 19 was prepared, with exception of the point that the silica was substituted by titan dioxide (Tipaque CR-ER made by Ishihara Sangyo kaisha Ltd.).

Example 20

Similar manner as that of Example 4 was executed and photosensitive member of Example 20 was prepared, with exception of the point that the silica was substituted by titan dioxide (Tipaque CR-ER made by Ishihara Sangyo kaisha Ltd.).

Example 21

Similar manner as that of Example 4 was executed and photosensitive member of Example 21 was prepared, with exception of the point that the aromatic sulfonic acid was substituted by 0.2 parts of citric acid.

Example 22

Similar manner as that of Example 4 was executed and photosensitive member of Example 22 was prepared, with exception of the point that the aromatic sulfonic acid was substituted by 0.036 parts of an amine-blocked aromatic sulfonic acid( Catalyst 50, 55% non volatile component made by MITSUI CYTEC LTD.).

Example 23

Similar manner as that of Example 4 was executed and photosensitive member of Example 23 was prepared, with exception of the point that the acrylic resin was substituted by 15 parts of an alkid resin (Bekkorite M6401-50, 50% non volatile component made by Dainippon Ink & Chemicals Inc.).

Comparative Example 1

Similar manner as that of Example 1 was executed and photosensitive member of Comparative Example 1 was prepared, with exception of the point that the acrylic resin and the melamine resin were substituted by 12.5 parts of a polycarbonate resin of bisphenol Z type.

Comparative Example 2

Similar manner as that of Example 3 was executed and photosensitive member of Comparative Example 2 was prepared, with exception of the point that the acrylic resin and the melamine resin were substituted by 12.5 parts of a polycarbonate resin of bisphenol Z type, and the aromatic sulfonic acid was not added.

Comparative Example 3

Similar manner as that of Example 17 was executed and photosensitive member of Comparative Example 3 was prepared, with exception of the point that the acrylic resin and the melamine resin were substituted by 12.5 parts of a polycarbonate resin of bisphenol Z type, and the aromatic sulfonic acid was not added.

Comparative Example 4

Similar manner as that of Example 19 was executed and photosensitive member of Comparative Example 3 was prepared, with exception of the point that the acrylic resin and the melamine resin were substituted by 12.5 parts of a polycarbonate resin of bisphenol Z type, and the aromatic sulfonic acid was not added.

Comparative Example 51

Similar manner as that of Example 3 was executed and photosensitive member of Comparative Example 5 was prepared, with exception of the point that the silica was not added.

Comparative Example 6

Similar manner as that of Example 4 was executed and photosensitive member of Comparative Example 6 was prepared, with exception of the point that the silica was not added.

Comparative Example 7

Similar manner as that of Example 3 was executed and photosensitive member of Comparative Example 7 was prepared, with exception of the point that aromatic sulfonic acid was not added.

Comparative Example 8

Similar manner as that of Example 4 was executed and photosensitive member of Comparative Example 8 was prepared, with exception of the point that aromatic sulfonic acid was not added.

Comparative Example 9

Similar manner as that of Example 4 was executed and photosensitive member of Comparative Example 9 was prepared, with exception of the point that the amount of the aromatic sulfonic acid was changed to 0.01 parts.

Comparative Example 10

Similar manner as that of Example 4 was executed and photosensitive member of Comparative Example 10 was prepared, with exception of the point that the amount of the aromatic sulfonic acid was changed to 2 parts.

Comparative Example 11

Similar manner as that of Example 4 was executed and photosensitive member of Comparative Example 11 was prepared, with exception of the point that the boric acid was used instead of the aromatic sulfonic acid.

Thus obtained electrophotographic photosensitive members were equipped on a color image forming apparatus, which was remodeled in the pressure intensity to be imposed on cleaning blade, and the development gaps between the surfaces of photoreceptor to be studied and development apparatus so as to impose stronger stress so that abrasion become significantly in the photoreceptor to be studied, from imagio MF 2200 by Ricoh Co. Ltd, which was remodeled in the pressure intensity to be imposed on cleaning blade, and the development gaps between the surfaces of photoreceptor to be studied and development apparatus so as to impose stronger stress so that abrasion become significantly in the photoreceptor to be studied. And which has no heater. And each initial potential level in the dark(VD) and lightened potential level (VL) of photosensitive members were determined. The remodeled imagio MF 2200 was repeatedly set so as to attain the initial potentials of negative 900V for each photoreceptor, then 50000 sheets of pass runs were conducted continuously, with measurements of each VD and VL, in addition, image evaluation were conducted, Further, thickness of layers including photosensitive layer were determined, using a layer thickness measuring apparatus of an eddy current type (Model 560 C by Fisher Instruments), amounts of abrasion were calculated from the differences between before and after pass runs. Results are shown in Table 1.

TABLE 1-1

| | protection layer | | | | | | | | | | after 10000 sheets run | | ablation amount (μm/10000 | |
|---|---|---|---|---|---|---|---|---|---|---|---|---|---|---|
| | | curable resin (A) | | | organic acid (B) | | | amount | fine particles | | | | | |
| | amount of CTM | used resin | amount | total amount | used acid | amount | total amount | ratio B/A(%) | used particles | amount | VD (−V) | VL (−V) | sheets pass) | obtained image |
| Ex. 1 | — | 50% AC Mel | 15 5 | 12.5 | 40% OrgSul | 0.05 | 0.02 | 0.16 | $SiO_2$ | 9 | 920 | 250 | less than or equal to 1 | good |
| Ex. 2 | 8.6 | Mel | 20 | 20 | 40% Org Sul | 0.05 | 0.02 | 0.1 | $SiO_2$ | 9 | 890 | 270 | less than or equal to 1 | slightly decrease in image density |
| Ex. 3 | 8.6 | 50% AC Mel | 15 5 | 12.5 | 40% Org Sul | 0.05 | 0.02 | 0.16 | $SiO_2$ | 9 | 890 | 185 | less than or equal to 1 | good |
| Ex. 4 | 8.6 | 50% AC 77% Gn | 15 6.5 | 12.505 | 40% Org Sul | 0.05 | 0.02 | 0.159 | $SiO_2$ | 9 | 890 | 170 | less than or equal to 1 | good |
| Ex. 5 | 8.6 | 60% AC Mel | 12.5 5 | 12.5 | 40% Org Sul | 0.05 | 0.02 | 0.16 | $SiO_2$ | 9 | 870 | 180 | less than or equal to 1 | good |
| Ex. 6 | 8.6 | 55% AC Mel | 13.6 5 | 12.48 | 40% Org Sul | 0.05 | 0.02 | 0.16 | $SiO_2$ | 9 | 880 | 170 | less than or equal to 1 | good |
| Ex. 7 | 8.6 | 50% AC 60% Mel | 15 8.3 | 12.48 | 40% Org Sul | 0.05 | 0.02 | 0.16 | $SiO_2$ | 9 | 875 | 185 | less than or equal to 1 | good |
| Ex. 8 | 8.6 | 50% AC Gn | 15 5 | 12.5 | 40% Org Sul | 0.05 | 0.02 | 0.16 | $SiO_2$ | 9 | 885 | 190 | less than or equal to 1 | good |
| Ex. 9 | 8.6 | 50% AC 70% Gn | 15 7.1 | 12.47 | 40% Org Sul | 0.05 | 0.02 | 0.16 | $SiO_2$ | 9 | 890 | 175 | less than or equal to 1 | good |
| Ex. 10 | 8.6 | 50% AC 77% Gn | 9.9 9.7 | 12.419 | 40% Org Sul | 0.05 | 0.02 | 0.16 | $SiO_2$ | 9 | 880 | 190 | less than or equal to 1 | good |
| Ex. 11 | 8.6 | 50% AC 77% Gn | 22.3 1.6 | 12.382 | 40% Org Sul | 0.05 | 0.02 | 0.16 | $SiO_2$ | 9 | 885 | 195 | less than or equal to 1 | good |

TABLE 1-2

| | protection layer | | | | | | | | | | after 10000 sheets run | | ablation amount (μm/10000 sheets pass) | |
|---|---|---|---|---|---|---|---|---|---|---|---|---|---|---|
| | | curable resin (A) | | | organic acid (B) | | | amount | fine particles | | | | | |
| | amount of CTM | used resin | amount | total amount | used acid | amount | total amount | ratio B/A(%) | used particles | amount | VD (−V) | VL (−V) | | obtained image |
| Ex. 12 | 4.1 | 50% AC<br>77% Gn | 15<br>6.5 | 12.505 | 40%<br>Org Sul | 0.05 | 0.02 | 0.159 | $SiO_2$ | 9 | 895 | 200 | less than or equal to 1 | good |
| Ex. 13 | 36.86 | 50% AC<br>77% Gn | 15<br>6.5 | 12.505 | 40%<br>Org Sul | 0.05 | 0.02 | 0.159 | $SiO_2$ | 9 | 875 | 160 | less than or equal to 1 | good |
| Ex. 14 | 8.6 | 50% AC<br>77% Gn | 15<br>6.5 | 12.505 | 40%<br>Org Sul | 1.0 | 0.4 | 3.198 | $SiO_2$ | 9 | 880 | 165 | less than or equal to 1 | good |
| Ex. 15 | 8.6 | 50% AC<br>77% Gn | 15<br>6.5 | 12.505 | 40%<br>Org Sul | 0.05 | 0.02 | 0.159 | $SiO_2$ | 1.2 | 890 | 175 | 2 | good |
| Ex. 16 | 8.6 | 50% AC<br>77% Gn | 15<br>6.5 | 12.505 | 40%<br>Org Sul | 0.05 | 0.02 | 0.159 | $SiO_2$ | 24 | 865 | 180 | less than or equal to 1 | good |
| Ex. 17 | 8.6 | 50% AC<br>Mel | 15<br>5 | 12.5 | 40%<br>Org Sul | 0.05 | 0.02 | 0.16 | $Al_2O_3$ | 9 | 875 | 220 | less than or equal to 1 | good |
| Ex. 18 | 8.6 | 50% AC<br>77% Gn | 15<br>6.5 | 12.505 | 40%<br>Org Sul | 0.05 | 0.02 | 0.159 | $Al_2O_3$ | 9 | 860 | 220 | less than or equal to 1 | good |
| Ex. 19 | 8.6 | 50% AC<br>Mel | 15<br>5 | 12.5 | 40%<br>Org Sul | 0.05 | 0.02 | 0.16 | $TiO_2$ | 9 | 880 | 200 | less than or equal to 1 | good |
| Ex. 20 | 8.6 | 50% AC<br>77% Gn | 15<br>6.5 | 12.505 | 40%<br>Org Sul | 0.05 | 0.02 | 0.159 | $TiO_2$ | 9 | 870 | 205 | less than or equal to 1 | good |
| Ex. 21 | 8.6 | 50% AC<br>77% Gn | 15<br>6.5 | 12.505 | Ctrc Ac | 0.2 | 0.2 | 1.599 | $SiO_2$ | 9 | 875 | 185 | less than or equal to 1 | good |
| Ex. 22 | 8.6 | 50% AC<br>77% Gn | 15<br>6.5 | 12.505 | 55%<br>Amn<br>Blc<br>ArSul | 0.036 | 0.0198 | 0.158 | $SiO_2$ | 9 | 870 | 180 | less than or equal to 1 | good |

TABLE 1-3

| | protection layer | | | | | | | | | | after 10000 sheets run | | ablation amount (μm/10000 sheets pass) | |
|---|---|---|---|---|---|---|---|---|---|---|---|---|---|---|
| | | curable resin (A) | | | organic acid (B) | | | amount | fine particles | | | | | |
| | amount of CTM | used resin | amount | total amount | used acid | amount | total amount | ratio B/A(%) | used particles | amount | VD (−V) | VL (−V) | | obtained image |
| Ex. 23 | 8.6 | 50% AC<br>Alkd<br>Mel | 15<br>5 | 12.5 | 40%<br>Org<br>Sul | 0.05 | 0.02 | 0.16 | $SiO_2$ | 9 | 895 | 215 | less than or equal to 1 | good |
| Com. Ex. 1 | — | Bisph Z PC | 12.5 | 12.5 | — | — | — | — | $SiO_2$ | 9 | 910 | 275 | less than or equal to 1 | generation of image blur |
| Com. Ex. 2 | 8.6 | Bisph Z PC | 12.5 | 12.5 | — | — | — | — | $SiO_2$ | 9 | 880 | 200 | less than or equal to 1 | generation of image blur |
| Com. Ex. 3 | 8.6 | Bisph Z PC | 12.5 | 12.5 | — | — | — | — | $Al_2O_3$ | 9 | 890 | 220 | less than or equal to 1 | generation of image blur |
| Com. Ex. 4 | 8.6 | Bisph Z PC | 12.5 | 12.5 | — | — | — | — | $Al_2O_3$ | 9 | 880 | 200 | less than or equal to 1 | generation of image blur |
| Com. Ex. 5 | 8.6 | 50% AC<br>Mel | 15<br>5 | 12.5 | 40%<br>Org<br>Sul | 0.05 | 0.02 | 0.16 | — | — | 860 | 180 | 4 | generation of spot stain in background |
| Com. Ex. 6 | 8.6 | 50% AC<br>77% Gn | 15<br>6.5 | 12.505 | 40%<br>Org<br>Sul | 0.05 | 0.02 | 0.159 | — | — | 850 | 190 | 5 | generation of spot stain in background |
| Com. Ex. 7 | 8.6 | 50% AC<br>Mel | 15<br>5 | 12.5 | — | — | — | — | $SiO_2$ | 9 | 880 | 170 | 4 | generation of spot stain in background |
| Com. Ex. 8 | 8.6 | 50% AC<br>77% Gn | 15<br>6.5 | 12.505 | — | — | — | — | $SiO_2$ | 9 | 875 | 195 | 4 | generation of spot stain in background |

TABLE 1-4

| | protection layer | | | | | | | | | | after 10000 sheets run | | ablation amount (μm/10000 sheets pass) | |
|---|---|---|---|---|---|---|---|---|---|---|---|---|---|---|
| | | curable resin (A) | | | organic acid (B) | | | amount | fine particles | | | | | |
| | amount of CTM | used resin | amount | total amount | used acid | amount | total amount | ratio B/A(%) | used particles | amount | VD (−V) | VL (−V) | | obtained image |
| Com. Ex. 9 | 8.6 | 50% AC 77% Gn | 15 6.5 | 12.505 | 40% Org Sul | 0.01 | 0.004 | 0.031 | $SiO_2$ | 9 | 880 | 200 | 10 | generation of background smear |
| Com. Ex. 10 | 8.6 | 50% AC 77% Gn | 15 6.5 | 12.505 | 40% Org Sul | 2.0 | 0.8 | 6.39 | $SiO_2$ | 9 | 865 | 150 | less than or equal to 1 | generation of image blur |
| Com. Ex. 11 | 8.6 | 50% AC 77% Gn | 15 6.5 | 12.505 | Bolic Ac | 0.5 | 0.5 | 3.99 | $SiO_2$ | 9 | 870 | 160 | less than or equal to 1 | generation of black spots |

AC: acrylic resin,
Mel: melamine resin,
Org Sul: aromatic sulfonic acid,
Ctrc Ac: citric acid,
Amn Blc. Ar. Sul: amine-blocked aromatic sulfonic acid,
Alkd: alkid resin, Bisph Z PC: bisphenol Z type of polycarbonate,
Boric Ac: boric acid,
CTM: charge transfer material Further, photoreceptors of Examples 1 to 4, 12 to 16, 21 to 23, and photoreceptors of Comparative Examples 1 to 4, 7, 9 to 11 were equipped on aforementiond remodeled imagio MF 2200 by Ricoh Co. Ltd., which was remodeled in the pressure intensity to be imposed on cleaning blade, and the development gaps between the surfaces of photoreceptor to be studied and development apparatus so as to impose stronger stress so that abrasion become significantly in the photoreceptor to be studied. And which has no heater. Then, continuos running tests 5000 sheets of runs were repeated with these photoreceptors, under the high temperature and high relative humidity of 30° C. and 90% RH, and under the low temperature and low relative humidity of 10° C. and 15%, continuously, with measurements of each VD and VL, in addition, image evaluation were conducted.

Example 24

Alkid resin (Bekkolite M6401-50 made by Dainippon Ink & Chemicals Inc.) 15 parts, melamine resin (Super Bekkamin G-821-60, 60% non volatile component made by Dainippon Ink & Chemicals Inc.) 10 parts were dissolved in 150 parts of methylethylketone, to this solution, 80 parts of titan dioxide powder (Tipaque CR-97 made by Ishihara Sangyo Kaisha, Ltd.) which being treated by finer particles of alumina and zirconium oxide and 10 parts of titan dioxide (Tipaque CR-67 made by Ishihara Sangyo Kaisha, Ltd.) which being treated by finer particles of alumina were added, then the liquid was dispersed for 24 hours using a ball mill, to prepare a coating liquid for under coat layer.

The obtained coating liquid for under coat layer was coated by a dip coating method onto an Al cylinder base having 50 mm diameter, 1 mm thickness and 340 mm length, then it was dried at 130° C. for 20 minutes, to form an under coat layer having 4 μm thickness on the Al cylinder base.

Then, 4 parts of polyvinylbutyral resin (S-lec HL-S made by Sekisui Chemical Co. Ltd.) were dissolved in 150 parts of cyclohexanone, to this solution, 10 parts of a bisazo pigment having a chemical formula (3) shown bellow, was added, then the mixture was dispersed for 48 hours using a ball mill, thereafter 210 parts of cyclohexanone were added and dispersed for three hours. The liquid was took out to a vessel and diluted by cyclohexanone so as to attain 1.5% of solid component content. Thus obtained coating liquid for preparing charge generating layer was coated on above described under coat layer, then it was dried at 130° C. for 20 minutes, to form a charge generating layer having 0.2 μm thickness on the under coat layer.

(3)

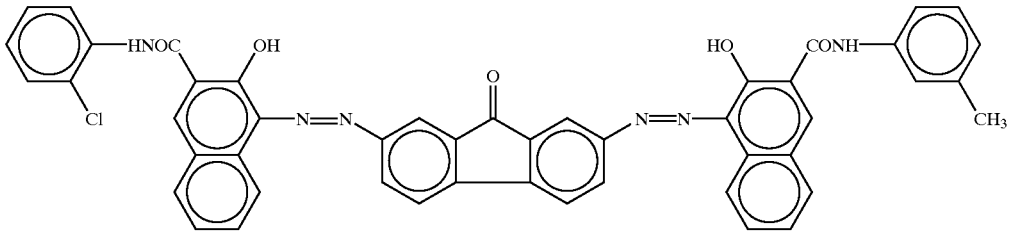

On the other hand, to 100 parts of tetrahydrofran, 10 parts of polycarbonate resin of bisphenol Z type, 0.002 parts of silicone oil (KF-50 made by Shin-Etsu Chemical) were dissolved, and to the solution, 8 parts of above described charge transfer material having a chemical formula (2) was added to prepare a coating liquid for the charge transfer layer, then it was coated on the charge generating layer, and dried it for 20 minutes at 110° C., to form a charge transfer layer having 20 μm thickness on the charge generating layer.

Further, to a mixed solvent consisting of 200 parts of cyclohexanone and 700 part of tetrahydrofran, 15 parts of acrylic resins (Hitaloid 3001:50% non volatile component made by Hitachi Chemical Co. Ltd.), 5 parts of melamine resin (Cymel 303: 100% non volatile component made by MITSUI CYTEC LTD.), 0.05 part of aromatic sulfonic acid (Catalist 4040: 40% non volatile component made by MITSUI CYTEC LTD., were dissolved, then 9 parts of silica (KMPX-100, made by Shin-etsu Chemical Ltd.) was added, the mixture was dispersed for 48 hours using a ball mill, to form a coating liquid for a protection layer.

The formed coating liquid was coated on the charge transfer layer by spray coating method, and dried at 130° C. for 20 minutes, to form a protection layer having 2 $\mu$m thickness on the charge transfer layer.

Thus an electrophotographic photosensitive member of Example 1 was prepared.

Same four photoreceptors were prepared, they were equipped an image forming apparatus shown in FIG. 8. Then, continuous 50000 sheets of running for tests were repeated with these photoreceptors, with the layer thickness of photoreceptors and evaluation for images obtained in initial run stage and after 50000 sheets run were conducted. The thickness of layers including photosensitive layer were determined, using a layer thickness measuring apparatus of an eddy current type (FISHERSCOPE MMS manufactured by Fischer Instruments), amounts of abrasion were calculated from the differences between before and after pass runs.

Example 25

Similar manner as that of Example 24 was executed and photosensitive member (photoreceptor) of Example 25 was prepared, with exception of the point that 8.6 parts of charge transfer material of above described chemical formula (2), 20 parts of melamine resin (Cymel 303 made by MITSUI CYTEC LTD.) were dissolved into 200 parts of cyclohexanone and 700 parts of tetrahydrofran, then 9 parts of silica (KMPX-100 made by Shin-etsu Chemical Ltd.) was added, and the liquid was treated by a ball mill for 48 hours, to form a coating layer for the protection layer was prepared, and similar evaluation as that of Example 24 was executed.

Example 26

Similar manner as that of Example 24 was executed and photosensitive member of Example 26 was prepared, with exception of the point that 8.6 parts of charge transfer material of above described chemical formula (2), 15 parts of acrylic resin (Hitaloid 3001, 50% non volatile component, made by Hitachi Chemical CO. Ltd.), 5 parts of melamine resin (Cymel 303 made by MITSUI CYTEC LTD.) were dissolved into 200 parts of cyclohexanone and 700 parts of tetrahydrofran, then 9 parts of silica (KMPX-100 made by Shin-etsu Chemical Ltd.) was added, and the liquid was treated by a ball mill for 48 hours, to form a coating layer for the protection layer was prepared, and similar evaluation as that of Example 24 was executed.

Example 27

Similar manner as that of Example 26 was executed and photosensitive member of Example 27 was prepared, with exception of the point that 5 parts of the melamine resin was substituted by 6.5 parts of guanamine resin (My coat 106, 77% of non volatile component made by MITSUI CYTEC LTD.), and similar evaluation as that of Example 24 was executed.

Example 28

Similar manner as that of Example 27 was executed and photosensitive member of Example 28 was prepared, with exception of the point that 15 parts of the acrylic resin was substituted by 12.5 parts of another acrylic resin (Hitaloid 2468 60% of non volatile component made by Hitachi Chemical CO. Ltd.), and similar evaluation as that of Example 24 was executed.

Example 29

Similar manner as that of Example 27 was executed and photosensitive member of Example 29 was prepared, with exception of the point that the amounts of the acrylic resin,and the guanamine resin were changed to respectively 9.9 parts, and 9.7 parts, and similar evaluation as that of Example 24 was executed.

Example 30

Similar manner as that of Example 27 was executed and photosensitive member of Example 30 was prepared, with exception of the point that the amounts of the acrylic resin and the guanamine resin were changed to respectively 22.3 parts, and 1.6 parts, and similar evaluation as that of Example 24 was executed.

Example 31

Similar manner as that of Example 27 was executed and photosensitive member of Example 31 was prepared, with exception of the point that the amounts of the charge transfer material having chemical formula (2) was changed to 4.1 parts, and similar evaluation as that of Example 24 was executed.

Example 32

Similar manner as that of Example 27 was executed and photosensitive member of Example 32 was prepared, with exception of the point that the amounts of the charge transfer material having chemical formula (2) was changed to 36.86 parts, and similar evaluation as that of Example 24 was executed.

Example 33

Similar manner as that of Example 27 was executed and photosensitive member of Example 33 was prepared, with exception of the point that the amounts of the aromatic sulfonic acid was changed to one(1) part, and similar evaluation as that of Example 24 was executed.

Example 34

Similar manner as that of Example 27 was executed and photosensitive member of Example 34 was prepared, with exception of the point that the amounts of the aromatic sulfonic acid was changed to 0.005 parts, and similar evaluation as that of Example 24 was executed.

Example 35

Similar manner as that of Example 27 was executed and photosensitive member of Example 35 was prepared, with exception of the point that the amounts of the silica was changed to 1.2 parts, and similar evaluation as that of Example 24 was executed.

Example 36

Similar manner as that of Example 27 was executed and photosensitive member of Example 36 was prepared, with exception of the point that the amounts of the silica was changed to 24 parts, and similar evaluation as that of Example 24 was executed.

Example 37

Similar manner as that of Example 26 was executed and photosensitive member of Example 37 was prepared, with exception of the point that the silica was substituted by almina (AA03 made by Sumitomo Chemical Co, Ltd.), and similar evaluation as that of Example 24 was executed.

Example 38

Similar manner as that of Example 27 was executed and photosensitive member of Example 38 was prepared, with exception of the point that the silica was substituted by almima (AA03 made by Sumitomo Chemical Co, Ltd.), and similar evaluation as that of Example 24 was executed.

Example 39

Similar manner as that of Example 26 was executed and photosensitive member of Example 39 was prepared, with exception of the point that the silica was substituted by titan dioxide (Tipaque CR-97 made by Ishihara Sangyo kaisha Ltd.), and similar evaluation as that of Example 24 was executed.

Example 40

Similar manner as that of Example 27 was executed and photosensitive member of Example 40 was prepared, with exception of the point that the silica was substituted by titan dioxide (Tipaque CR-97 made by Ishihara Sangyo kaisha Ltd.), and similar evaluation as that of Example 24 was executed.

Example 41

Similar manner as that of Example 27 was executed and photosensitive member of Example 41 was prepared, with exception of the point that the aromatic sulfonic acid was substituted by citric acid, and similar evaluation as that of Example 24 was executed.

Example 42

Similar manner as that of Example 27 was executed and photosensitive member of Example 42 was prepared, with exception of the point that the aromatic sulfonic acid was substituted by 0.036 part of an amine-blocked aromatic sulfonic acid( Catalyst 4050, 55% non volatile component made by MITSUI CYTEC LTD.), and similar evaluation as that of Example 24 was executed.

Comparative Example 12

Similar manner as that of Example 24 was executed and photosensitive member of Comparative Example 12 was prepared, with exception of the point that the acrylic resin and the melamine resin were substituted by 12.5 part of a polycarbonate resin of bisphenol Z type, and similar evaluation as that of Example 24 was executed.

Comparative Example 13

Similar manner as that of Example 26 was executed and photosensitive member of Comparative Example 13 was prepared, with exception of the point that the acrylic resin and the melamine resin were substituted by 12.5 parts of a polycarbonate resin of bisphenol Z type, and the aromatic sulfonic acid was not added, and similar evaluation as that of Example 24 was executed.

Comparative Example 14

Similar manner as that of Example 41 was executed and photosensitive member of Comparative Example 14 was prepared, with exception of the point that the acrylic resin and the melamine resin were substituted by 12.5 parts of a polycarbonate resin of bisphenol Z type, and the aromatic sulfonic acid was not added, and similar evaluation as that of Example 24 was executed.

Comparative Example 15

Similar manner as that of Example 26 was executed and photosensitive member of Comparative Example 15 was prepared, with exception of the point that the silica was not added, and similar evaluation as that of Example 24 was executed.

Comparative Example 16

Similar manner as that of Example 27 was executed and photosensitive member of Comparative Example 16 was prepared, with exception of the point that the silica was not added, and similar evaluation as that of Example 24 was executed.

Comparative Example 17

Similar manner as that of Example 26 was executed and photosensitive member of Comparative Example 17 was prepared, with exception of the point that aromatic sulfonic acid was not added, and similar evaluation as that of Example 24 was executed.

Comparative Example 18

Similar manner as that of Example 27 was executed and photosensitive member of Comparative Example 18 was prepared, with exception of the point that aromatic sulfonic acid was not added, and similar evaluation as that of Example 24 was executed.

These results are shown in Table 2.

With regard to the values of abrasions of the examined photosensitive members, the measurements result for abrasion amounts of the four photosensitive members revealed that very little difference between them was noticeable, therefore, a value recorded with the photosensitive member positioned in the last place of downstream side in FIG. 8 (namely rightmost in FIG. 8) is shown in Table 2.

TABLE 2

| | ablation amount ($\mu$m/ 50000 sheets pass) | image after run of sheets pass |
|---|---|---|
| Ex. 24 | less than or equal to 1 | slightly decrease in image density |
| Ex. 25 | less than or equal to 1 | slightly decrease in image density |
| Ex. 26 | less than or equal to 1 | few generation of image having worm-eaten holes |
| Ex. 27 | less than or equal to 1 | few generation of image having worm-eaten holes |
| Ex. 28 | less than or equal to 1 | good |
| Ex. 29 | less than or equal to 1 | few generation of image having worm-eaten holes |
| Ex. 30 | less than or equal to 1 | good |
| Ex. 31 | less than or equal to 1 | few generation of image having worm-eaten holes |

TABLE 2-continued

| | ablation amount (μm/ 50000 sheets pass) | image after run of sheets pass |
|---|---|---|
| Ex. 32 | less than or equal to 1 | good |
| Ex. 33 | less than or equal to 1 | few generation of background smear |
| Ex. 34 | less than or equal to 1 | good |
| Ex. 35 | less than or equal to 1 | good |
| Ex. 36 | less than or equal to 1 | few generation of image having worm-eaten holes |
| Ex. 37 | less than or equal to 1 | slightly decrease in image density |
| Ex. 38 | less than or equal to 1 | slightly decrease in image density |
| Ex. 39 | 2 | few generation of background smear |
| Ex. 40 | less than or equal to 1 | few generation of background smear |
| Ex. 41 | less than or equal to 1 | good |
| Ex. 42 | less than or equal to 1 | good |
| Com. Ex. 12 | less than or equal to 1 | generation of image blur |
| Com. Ex. 13 | less than or equal to 1 | generation of image blur |
| Com. Ex. 14 | less than or equal to 1 | generation of image blur |
| Com. Ex. 15 | 8 | generation of background smear |
| Com. Ex. 16 | 7 | generation of background smear |
| Com. Ex. 17 | 7 | generation of background smear |
| Com. Ex. 18 | 8 | generation of background smear |

As will be clear by the results shown in Table 2, the apparatus of the present invention shows very scarce abrasion, and image blur is hardly occurred, further, even it having been used for $4\times10^5$ to $5\times10^5$ runs of sheet, a very slight generation of density decrease of image, smear in background area, inferior image having defect like as worm-eaten trace may be detected, however they are not problem in almost all practical situations.

Example 43

Similar manner as that of Example 26 was executed and photosensitive member of Example 43 was prepared, with exception of the point that the intermediate transfer belt was substituted by an intermediate transfer belt prepared by method shown next Example 44, then sheets passing tests and image evaluation were conducted. An improved results are caused that the inferior image having defect like as worm-eaten trace was significantly decreased, and image qualities were improved.

Example for Preparation of Elastic Intermediate Transfer Belt

A cylindrical die was dipped in a bath containing a dispersion which consists of homogenous mixture of 100 parts of PVDF, 18 parts of carbonblak, 3 parts of dipersant, 400 parts of toluene. The die was then drawn up, with a velocity of 10 m/sec. and with tranquility, from the bath. This operation were repeated until PVDF belt having 150 μm thickness obtained. Then the die having PVDF belt source was dipped in a dispersion liquid containing 100 parts of polyurethane prepolymer, 3 parts of hardening agent (isocyanate), 20 parts of carbon black, 3 parts of dispersant, 500 parts of methylethylketone. The die was then drawn up, with a velocity of 30 mm/sec. and with tranquility enough, from the dispersion liquid and dried. This operation were repeated until adequate elasticity was attained.

Further, the surface of the PVDF belt was coated by a liquid containing 100 parts of polyurethane prepolymer, 3 parts of hardening agent (isocyanate), 50 parts of PTFE fine powder, 3 parts of dispersant, 500 parts of methylethylketone.

Namely, the PVDF belt was again dipped in the coating liquid, then drawn up, with a velocity of 30 mm/sec. and with tranquility enough, from the coating liquid and dried at room temperature, then cross-linked at 130° C. for two hours, to obtain a PVDF elastic belt having 150 μm thickness of resin layer and 150 μm thickness of elastic layer, Example 44

Similar manner as that of Example 27 was executed and photosensitive member of Example 43 was prepared, with exception of the point that the intermediate transfer belt was substituted by an intermediate transfer belt prepared by method shown next Example 44, then sheets passing tests and image evaluation were conducted. An improved results are caused that the inferior image having defect like as worm-eaten trace was significantly decreased, and image qualities were improved.

What is claimed is:

1. An electrophotographic photosensitive member having a photosensitive layer provided on an electro-conductive supporting substrate and a protection layer provided on the photosensitive layer, wherein the protection layer at least comprises a finely divided metal oxide particle, an organic acid and a thermo-curable binder resin, and wherein the organic acid is contained in an amount of 0.05 wt. % to 5 wt. % for the amount of the thermo-curable resin.

2. An electrophotographic photosensitive member according to claim 1, wherein the protection layer contains a charge transfer material.

3. An electrophotographic photosensitive member according to claim 1, wherein the protection layer contains a charge transfer material, and the ratio by weight of the binder resin and the charge transfer material in the protection layer is in the range of 3/1 to 1/3.

4. An electrophotographic photosensitive member according to claim 1, wherein the binder resin of the protection layer is a binder resin consisting of a mixture of two or more heat-curable resin components being cured.

5. An electrophotographic photosensitive member according to claim 1, wherein the binder resin of the protection layer is a binder resin consisting of a mixture of two or more heat-curable resin components being cured, and at least one heat-curable resin component is a thermo-curable acrylic resin.

6. An electrophotographic photosensitive member according to claim 1, wherein the binder resin of the protection layer is a binder resin consisting of a mixture of two or more heat-curable resin components being cured, and at least one heat-curable resin component is a melamine resin or a guanamine resin.

7. An electrophotographic photosensitive member according to claim 1, wherein the binder resin of the protection layer is a binder resin consisting of a mixture of a heat-curable acrylic resin and either a heat-curable melamine resin or a heat-curable guanamine resin.

8. An electrophotographic photosensitive member according to claim 1, wherein the binder resin of the protection layer is a binder resin consisting of a mixture of a heat-curable acrylic resin and either a heat-curable melamine resin or a heat-curable guanamine resin, and the ratio by weight of the acrylic resin and either the melamine resin or the guanamine resin is in the range of 9/1 to 4/6.

9. An electrophotographic photosensitive member according to claim 1, wherein the finely divided metal oxide particle is consisted of one or more fine particles containing any one of silica, alumina or titanim dioxide particles.

10. An electrophotographic photosensitive member according to claim 1, wherein an amount of the finely divided metal oxide particle for an amount of binder resin ranges from 10 to 200% by weight.

11. An electrophotographic photosensitive member according to claim 1, wherein the organic acid is an aromatic sulfonic acid or derivatives thereof.

12. An electrophotographic photosensitive member according to claim 1, wherein the photosensitive layer is an organic photosensitive layer constituted by a charge generating layer and a charge transfer layer piled up one by one.

13. An electrophotographic photosensitive member according to claim 1, wherein the photosensitive layer is an organic photosensitive layer constituted by a charge generating layer and a charge transfer layer piled up one by one, and an under coat layer is being provided between the electro-conductive supporting substrate and the photosensitive layer.

14. A coating liquid for a protection layer of an electrophotographic photosensitive member having a photosensitive layer provided on an electro-conductive supporting substrate and the protection layer provided on the photosensitive layer, wherein the coating liquid contains 0.5 to 30% by weight of solid component for the total amount of the coating liquid, the solid component at least contains a finely divided metal oxide particle, an organic acid and a thermo-curable binder resin, and wherein the organic acid is contained in an amount of 0.05 wt. % to 5 wt. % for the amount of the thermo-curable resin.

15. A preparation method of an electrophotographic photosensitive member comprising the steps of:

applying a coating liquid used for forming a protection layer of the electrophotographic photosensitive member by spraying the coating liquid onto a photosensitive layer; and heatsetting the coating liquid to form the protection layer, wherein the coating liquid contains 0.5 to 30% by weight of solid component for the total amount of the coating liquid, the solid component consists of a thermo-curable binder resin, a finely divided metal oxide particle, and an organic acid, and wherein the amount of the organic acid is 0.05 wt. % to 5 wt. % for the amount of the thermo-curable resin.

16. An image forming process comprising the steps of:

forming an electric latent image upon an electrophotographic photosensitive member;

developing the latent image to make a toner image; and transferring the toner image onto a image receiving medium, wherein the electrophotographic photosensitive member has a photosensitive layer provided on an electro-conductive supporting substrate and a protection layer provided on the photosensitive layer, the protection layer at least comprises a finely divided metal oxide particle, an organic acid and a thermo-curable binder resin, and wherein the organic acid is contained in an amount of 0.05 wt. % to 5 wt. % for the amount of the thermo-curable resin.

17. An image forming process according to claim 16, wherein the latent image forming step for forming an electric latent image upon the electrophotographic photosensitive member comprises the steps of:

electrically charging the electrophotographic photosensitive member; and exposing the electrophotographic photosensitive member with a light irradiation of image shape or with an emission of a light beam.

18. An image forming apparatus comprising:

an electrophotographic photosensitive member having a photosensitive layer provided on an electrically conductive supporting substrate and a protection layer provided on the photosensitive layer;

a latent image forming apparatus for forming an electrostatic latent image on the surface of the electrophotographic photosensitive member; and a developing apparatus for developing the electrostatic latent image, wherein the protection layer at least comprises a kind of finely divided metal oxide particle, an organic acid and a thermo-curable binder resin, and wherein the organic acid is contained in an amount of 0.05 wt. % to 5 wt. for the amount of the thermo-curable resin.

19. An image forming apparatus comprising:

a plurality of image forming units, and each image forming unit includint:

an electrophotographic photosensitive member having a photosensitive layer provided on an electric conductive supporting substrate and a protection layer provided on the photosensitive layer;

a latent image forming apparatus for forming an electrostatic latent image on the surface of the electrophotographic photosensitive member; and a developing apparatus for developing the electrostatic latent image into a toner image, a toner image-transfer unit for transferring the toner image;

a toner image-receiving medium on which toner images of the image forming units are transferred one by one; and a driving mean for driving the toner image-receiving medium, so as to move the surface of the toner image-receiving medium to be faced to the each surface of respective electrophotographic photosensitive member by sequential order, wherein the protection layer at least comprises a kind of finely divided metal oxide particle, an organic acid and a thermo-curable binder resin, and wherein the organic acid being is contained in an amount of 0.05 wt. % to 5 wt. % for the amount of the thermo-curable resin.

20. An image forming apparatus according to claim 19, wherein the latent image forming apparatus has an electric charging member contacted with or adjacent to the electrophotographic photosensitive member.

21. An image forming apparatus according to claim 19, wherein the toner image-receiving medium is an intermediate transfer medium, toner images on the plurality of electorophotographic photosensitive members are primary transferred to form over-laid images on the intermediate transfer medium one by one, and the over-laid images on the intermediate transfer medium are composed and secondary transferred onto a recording member.

22. An image forming apparatus according to claim 19, wherein the toner image-receiving medium is an intermediate transfer medium, toner images on the plurality of electorophotographic photosensitive members are primary transferred to form over-laid images on the intermediate transfer medium one by one, and the over-laid images on the intermediate transfer medium are composed and secondary transferred onto a recording member, and wherein the intermediate transfer medium is an elastic seamless belt constituted by an elastic material in the whole of it or at least one layer thereof.

23. An image forming apparatus according to claim 19, wherein the toner image-receiving medium is an intermediate transfer medium, toner images on the plurality of electorophotographic photosensitive members are primary transferred to form over-laid images on the intermediate transfer medium one by one, and the over-laid images on the intermediate transfer medium are composed and secondary transferred onto a recording member, and wherein the intermediate transfer medium has a hardness (HS) by JIS(Japanese Industrial Standard)—A in the range 10° to 65°.

24. An image forming apparatus according to claim 19, wherein the toner image-receiving medium is an intermediate transfer medium, toner images on the plurality of electorophotographic photosensitive members are primary transferred to form over-laid images on the intermediate transfer medium one by one, and the over-laid images on the intermediate transfer medium are composed and secondary transferred onto a recording member, and wherein the intermediate transfer medium has a wick layer.

25. A detachable process cartridge for image forming apparatus comprising:

an electorophotographic photosensitive member having a photosensitive layer provided on an electric conductive supporting substrate and a protection layer provided on the photosensitive layer;

means for forming an image;

means for developing the image; and means for transferring the image;

wherein the protection layer at least comprises a kind of finely divided metal oxide particle, an organic acid and a thermo-curable binder resin, and wherein the organic acid is contained in an amount of 0.05 wt. % to 5 wt. % for the amount of the thermo-curable resin.

* * * * *

UNITED STATES PATENT AND TRADEMARK OFFICE

CERTIFICATE OF CORRECTION

PATENT NO. : 6,830,858 B2
DATED : December 14, 2004
INVENTOR(S) : Sugino et al.

It is certified that error appears in the above-identified patent and that said Letters Patent is hereby corrected as shown below:

Title page,
Item [30], Foreign Application Priority Data, should read
-- [30] Foreign Application Priority Data
Jun. 27, 2001 (JP)……..P2001-194250
Sep. 4, 2001 (JP)……...P2001-267609
Jun. 24, 2002 (JP)……P2002-182660 --

Signed and Sealed this

Fifth Day of April, 2005

JON W. DUDAS
*Director of the United States Patent and Trademark Office*